US007173611B2

(12) United States Patent
Morita

(10) Patent No.: US 7,173,611 B2
(45) Date of Patent: Feb. 6, 2007

(54) DISPLAY SYSTEM AND DISPLAY CONTROLLER

(75) Inventor: Akira Morita, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 622 days.

(21) Appl. No.: 10/717,435

(22) Filed: Nov. 19, 2003

(65) Prior Publication Data

US 2004/0140970 A1 Jul. 22, 2004

(30) Foreign Application Priority Data

Dec. 24, 2002 (JP) ..... 2002-372147

(51) Int. Cl.
*G09G 5/00* (2006.01)

(52) U.S. Cl. ..... 345/204; 345/100

(58) Field of Classification Search ..... 345/87, 345/98–100, 204–206, 212–214; 348/564–565
See application file for complete search history.

(56) References Cited

U.S. PATENT DOCUMENTS 6,566,643 B2 5/2003 Morita
6,657,648 B1 * 12/2003 Aoki ..... 345/204
6,930,675 B2 * 8/2005 Ishiyama ..... 345/204
7,015,902 B2 * 3/2006 Nagai et al. ..... 345/204

FOREIGN PATENT DOCUMENTS

JP 2002-023709 1/2002

* cited by examiner

*Primary Examiner*—Richard Hjerpe
*Assistant Examiner*—Duc Dinh
(74) *Attorney, Agent, or Firm*—Hogan & Hartson LLP

(57) ABSTRACT

A controller outputs display data in a j-bit unit through first to j-th data output terminals and command data for controlling a data line drive circuit through a (j+1)th data output terminal. The controller also outputs a command identification signal for identifying command data, to the data line drive circuit through a (j+2)th data output terminal. The data line drive circuit includes a latch which fetches command data specified according to the command identification signal, a decoder which decodes the fetched command data, and a control section which outputs a control signal corresponding to a decoding result by the decoder, and the data line drive circuit drives a plurality of data lines of a liquid-crystal panel, based on the input display data and the control signal.

18 Claims, 25 Drawing Sheets

DISPLAY SYSTEM AND DISPLAY CONTROLLER

Japanese Patent Application No. 2002-372147, filed on Dec. 24, 2002, is hereby incorporated by reference in its entirety.

BACKGROUND OF THE INVENTION

The present invention relates to a display system and a display controller.

A liquid-crystal panel (generally speaking: a display panel; more generally speaking: a electro-optical device) is used as a display section of an electronic appliance such as a mobile phone, with the intention of making the electronic appliance lighter, smaller, and more energy efficient. Such a liquid-crystal panel is controlled by a display controller that executes display control after receiving instructions from a host (CPU) that imposes control over the electronic appliance.

The liquid-crystal panel includes a plurality of scan lines, a plurality of data lines, and a plurality of pixels. The scan lines are scanned by a scan line drive circuit. The data lines are driven by a data line drive circuit. A display controller supplies display data to the data line drive circuit and also performs timing control for the scan line drive circuit and the data line drive circuit.

BRIEF SUMMARY OF THE INVENTION

One aspect of the present invention relates to a display system comprising:

a display panel including a plurality of pixels, a plurality of data lines, and a plurality of scan lines;

a display driver which drives the data lines; and a display controller which supplies display data to the display driver and also controls the display driver, wherein the display controller:

includes first to (j+2)th data output terminals (where j is a natural number) for outputting (j+2) bits of display data out of display data that is output in a k-bit unit (where k is an integer such that $k \geqq j+2$);

outputs display data in a j-bit unit to the display driver through the first to j-th data output terminals;

outputs command data for controlling the display driver instead of the (j+1)th bit of display data, through the (j+1)th data output terminal to the display driver; and outputs a command identification signal for identifying the command data instead of the (j+2)th bit of display data, through the (j+2)th data output terminal to the display driver, and wherein the display driver includes:

first to j-th data input terminals for inputting display data in a j-bit unit;

a latch which fetches the command data that is specified according to the command identification signal;

a decoder which decodes the command data fetched into the latch; and a control section which outputs a control signal corresponding to a decoding result by the decoder, the display driver driving the data lines based on the control signal and the display data that has been input through the first to j-th data input terminals.

Another aspect of the present invention relates to a display system comprising:

a display panel including a plurality of pixels, a plurality of data lines, and a plurality of scan lines;

a display driver which drives the data lines; and a display controller which supplies multiplexed data including display data to the display driver and also controls the display driver, wherein the display controller:

includes first to (j+1)th data output terminals (where j is a natural number) for outputting (j+1) bits of display data out of display data that is output in a k1-bit unit (where k1 is an integer such that $k1 \geqq j+1$);

outputs multiplexed data in which display data and command data has been time-division multiplexed within one horizontal scan period, in a j-bit unit to the display driver through the first to j-th data output terminals; and outputs a command identification signal for identifying the command data instead of the (j+1)th bit of display data, to the display driver through the (j+1)th data output terminal, and wherein the display driver includes:

first to j-th data input terminals for inputting display data in a j-bit unit;

a latch which fetches command data from the multiplexed data, specified according to the command identification signal;

a decoder which decodes the command data fetched into the latch; and a control section which outputs a control signal corresponding to a decoding result by the decoder; the display driver driving the data lines based on the control signal and the display data included within the multiplexed data that has been input through the first to j-th data input terminals.

A further aspect of the present invention relates to a display system comprising:

a display panel including a plurality of pixels, a plurality of data lines, and a plurality of scan lines;

a display driver which drives the data lines; and a display controller which supplies display data to the display driver and also controls the display driver;

wherein the display controller:

includes first to (j+p)th data output terminals (where j is a natural number) for outputting (j+p) bits of display data out of display data that is output in a k2-bit unit (where k2 and p are positive integers such that $k2 \geqq j+p$);

outputs display data in a j-bit unit to the display driver through the first to j-th data output terminals; and outputs command data instead of the (j+1)th to (j+p)th bits of the display data through the (j+1)th to (j+p)th data output terminals to the display driver, and wherein the display driver includes:

first to j-th data input terminals for inputting display data in a j-bit unit;

a latch which fetches the command data;

a decoder which decodes the command data fetched into the latch; and a control section which outputs a control signal corresponding to a decoding result by the decoder, the display driver driving the data lines based on the control signal and the display data that has been input through the first to j-th data input terminals.

A still further aspect of the present invention relates to a display controller which controls a display driver which drives a data line of a display panel, based on display data which is input in a j-bit unit (where j is a natural number); the display controller including:

first to (j+2)th data output terminals;

a mode setting register for setting an operation mode of the display controller to a first or second mode;

a command data output section which outputs command data for controlling the display driver and a command identification signal for specifying the command data; and a display data output section which outputs display data in a k-bit unit (where k is an integer such that k≧j+2) or a j-bit unit, wherein the display data output section:

outputs (j+2) bits of display data out of display data that is output in a k-bit unit, through the first to (j+2)th data output terminals, in a first mode; and outputs display data in a j-bit unit through the first to j-th data output terminals, and also outputs command data instead of the (j+1)th bit of display data through the (j+1)th data output terminal and the command identification signal instead of the (j+2)th bit of display data through the (j+2)th data output terminal, in a second mode.

An even further aspect of the present invention relates to a display controller which controls a display driver which drives a data line of a display panel, based on display data which is input in a j-bit unit (where j is a natural number); the display controller comprising:

first to (j+1)th data output terminals;

a mode setting register for setting an operation mode of the display controller to a first or second mode;

a command data output section which outputs a command identification signal for specifying command data for controlling the display driver; and a display data output section which outputs multiplexed data in which display data in a k1-bit unit (where k1 is an integer such that k1≧j+1) or a j-bit unit and the command data are multiplexed, within one horizontal scan period, wherein the display data output section:

outputs the multiplexed data including (j+1) bits of display data out of display data that is output in a k1-bit unit, through the first to (j+1)th data output terminals, in a first mode; and outputs the multiplexed data including display data in a j-bit unit through the first to j-th data output terminals, and also outputs the command identification signal at a time corresponding to command data included within the display data instead of the (j+1)th bit of display data, through the (j+1)th data output terminal, in a second mode.

A yet further aspect of the present invention relates to a display controller which controls a display driver which drives a data line of a display panel, based on display data which is input in a j-bit unit (where j is a natural number); the display controller comprising:

first to (j+p)th (where p is a natural number) data output terminals;

a mode setting register for setting an operation mode of the display controller to a first or second mode;

a command data output section which outputs command data for controlling the display driver; and a display data output section which outputs display data in a k2-bit unit (where k2 is a positive integer such that k2≧j+p) or a j-bit unit, wherein the display data output section:

outputs (j+p) bits of display data out of display data that is output in a k2-bit unit, through the first to (j+2)th data output terminals, in a first mode; and outputs display data in a j-bit unit through the first to j-th data output terminals, and also outputs command data instead of the (j+1)th to (j+p)th bits of display data through the (j+1)th to (j+p)th data output terminals, in a second mode.

DETAILED DESCRIPTION OF THE EMBODIMENT

Embodiments of the present invention are described below. Note that the embodiments described below do not limit the scope of the present invention as laid out in the claims herein. In addition, the entirety of the configurations described with reference to these embodiments are not limited to being essential structural components of the present invention.

When a display controller that has received instructions from a host controls a data line drive circuit (generally speaking: a display driver), one method that can be considered involves the display controller outputting control signals to control the data line drive circuit directly. However, if the control details become complicated with this method, the number of signal lines increases, which raises problems concerning signal delays due to the wiring and the guaranteeing of sufficient area for the wiring, making it impossible to design for lower power consumptions and costs.

In contrast thereto, another method that could be considered involves preparing command data corresponding to the control details for a display controller, and having the display controller set that command data in the data line drive circuit. In such a case, the data line drive circuit analyzes the thus set command data in those details, and performs the control in accordance with the result of the analysis. Since this has the advantage of simply increasing the types of command data, even if the control details become complicated, it enables expansion. However, this method makes it necessary to provide the display controller with command data input-output functions. If a general-purpose controller is provided with functions for inputting and outputting command data, therefore, the display controller becomes more complicated, the chip dimensions increase, and problems arise concerning fabrication costs and times.

The embodiments described below make it possible to provide a display system and display controller that can input command data even with a general-purpose controller.

These embodiments are described below with reference to the accompanying figures. The description of the embodiments below are based on a TFT panel that is an active-matrix type of liquid-crystal panel, by way of example, but the present invention is not limited thereto.

1. First Embodiment

Figure 1:
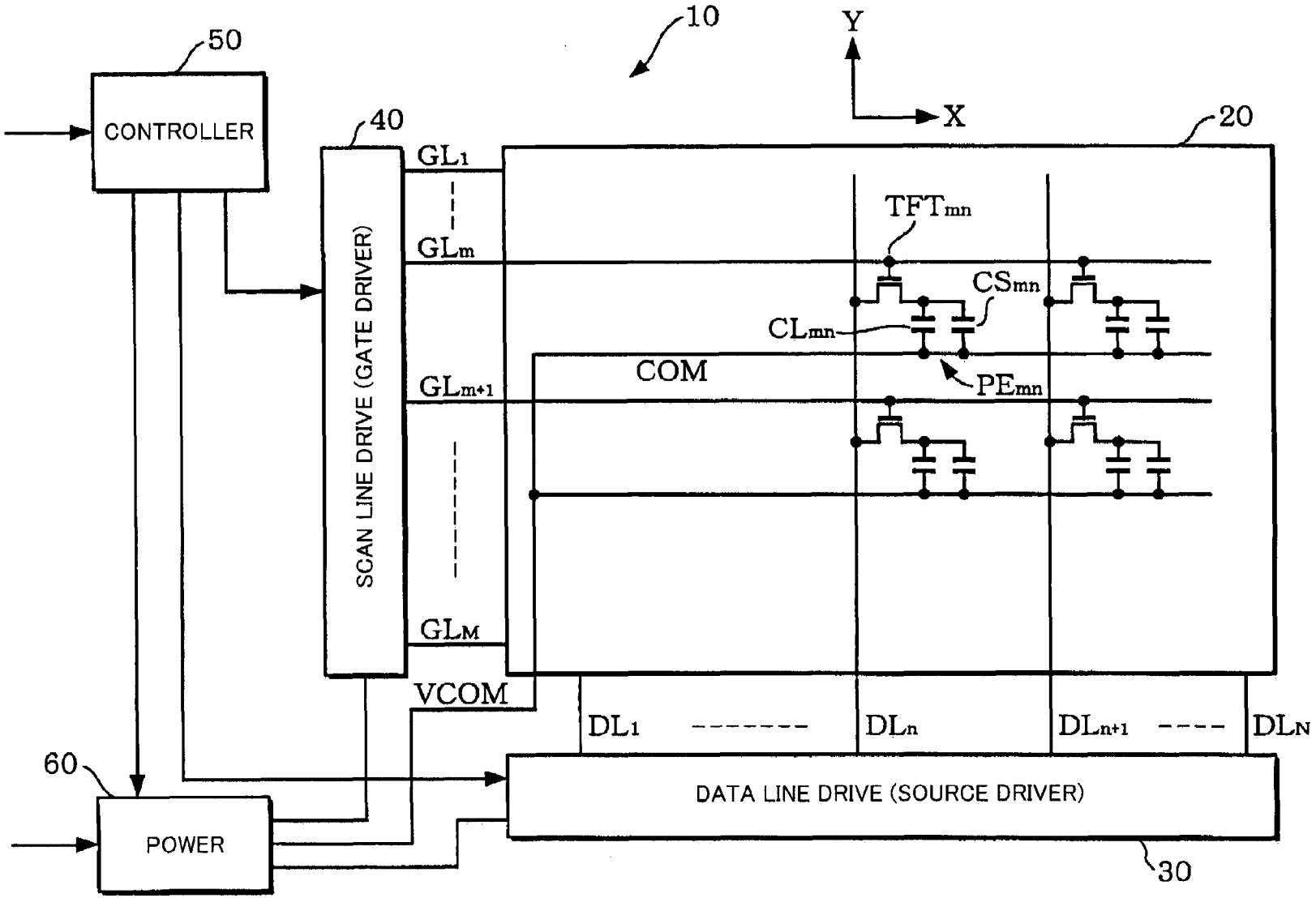
FIG. 1 schematically shows a structure of a liquid-crystal device.

An outline of the configuration of a liquid-crystal device is shown in FIG. 1. This liquid-crystal device (generally speaking: a display system) could be incorporated in any of a variety of electronic appliances, such as a mobile phone, a portable information device (such as a PDA), a digital camera, a projector, a portable audio player, a mass-storage device, a video camera, an electronic organizer, or a global positioning system (GPS) device.

In FIG. 1, a liquid-crystal device 10 includes a liquid-crystal panel (generally speaking: a display panel; more generally speaking: a electro-optical device) 20, a data line drive circuit (more specifically: a source driver) 30, a scan line drive circuit (more specifically: a gate driver) 40, a controller 50, and a power circuit 60. The liquid-crystal device 10 could be an electro-optical device. The data line drive circuit 30 could be a display driver.

Note that not all of these circuit blocks are essential for the liquid-crystal device 10; it is also possible to have a configuration without some of these components.

The liquid-crystal panel 20 includes a plurality of scan lines (gate lines), a plurality of data lines (source lines), and a plurality of pixels such that each pixel is specified by one scan line of the scan lines and one data line of the data lines. Each pixel includes a TFT and a pixel electrode. The TFT is connected to the data line and the pixel electrode is connected to that TFT.

More specifically, the liquid-crystal panel 20 is formed on a panel substrate such as a glass substrate, by way of example. Disposed on the panel substrate are scan lines $GL_1$ to $GL_M$ (where M is an integer of at least two digits), which are disposed in the Y direction in FIG. 1 in a plurality of lines each extending in the X direction, and data lines $DL_1$ to $DL_N$ (where N is an integer of at least two digits), which are disposed in the X direction in a plurality of lines each extending in the Y direction. A pixel $PE_{mn}$ is provided at a position corresponding to the intersection between a scan line $GL_m$ (where m is an integer such that $1 \leqq m \leqq M$) and a data line $DL_n$ (where n is an integer such that $1 \leqq n \leqq N$). The pixel $PE_{mn}$ includes a $TFT_{mn}$ and a pixel electrode.

The gate electrode of $TFT_{mn}$ is connected to the scan line $GL_m$. The source electrode of $TFT_{mn}$ is connected to the data line $DL_n$. The drain electrode of $TFT_{mn}$ is connected to the pixel electrode. A liquid-crystal capacitance $CL_{mn}$ and a subsidiary capacitance $CS_{mn}$ are generated between the pixel electrode and an opposing electrode COM (common electrode) that faces that pixel electrode with a liquid-crystal element (generally speaking: an electro-optical material) therebetween. The transmissivity of the pixel varies with the voltage applied between the pixel electrode and the opposing electrode COM. A voltage VCOM supplied to the opposing electrode COM is created by the power circuit 60.

The data line drive circuit 30 drives the data lines $DL_1$ to $DL_N$ of the liquid-crystal panel 20, based on display data. The scan line drive circuit 40 scans the scan lines $GL_1$ to $GL_M$ of the liquid-crystal panel 20.

The controller 50 outputs control signals for the data line drive circuit 30, the scan line drive circuit 40, and the power circuit 60, in accordance with details set by a host such as a central processing unit (hereinafter abbreviated to CPU) that is not shown in the figure. More specifically, the controller 50 supplies the data line drive circuit 30 and the scan line drive circuit 40 with a horizontal synchronization signal and a vertical synchronization signal that are generated based on details such as the operating mode and settings. The controller 50 also controls the polarity inversion timing of the voltage VCOM of the opposing electrode COM.

The power circuit 60 generates the various voltages used by the liquid-crystal panel 20 and the voltage VCOM of the opposing electrode COM, based on a reference voltage supplied from the outside.

Note that FIG. 1 shows a configuration in which the liquid-crystal device 10 includes the controller 50, but the controller 50 could equally well be provided outside of the liquid-crystal device 10. Alternatively, the configuration could be such that both the controller 50 and the host (not shown in the figure) are included within the liquid-crystal device 10.

At least one of the scan line drive circuit 40, the controller 50, and the power circuit 60 could be incorporated into the data line drive circuit 30.

Similarly, some or all of the data line drive circuit 30, the scan line drive circuit 40, the controller 50, and the power circuit 60 could be formed on the liquid-crystal panel 20. For example, the liquid-crystal panel (electro-optical device) 20 could be configured to include a plurality of data lines; a plurality of scan lines; a plurality of pixels, each specified by one of the data lines and one of the scan lines; and a data line drive circuit (display driver) for driving the data lines.

Figure 2:
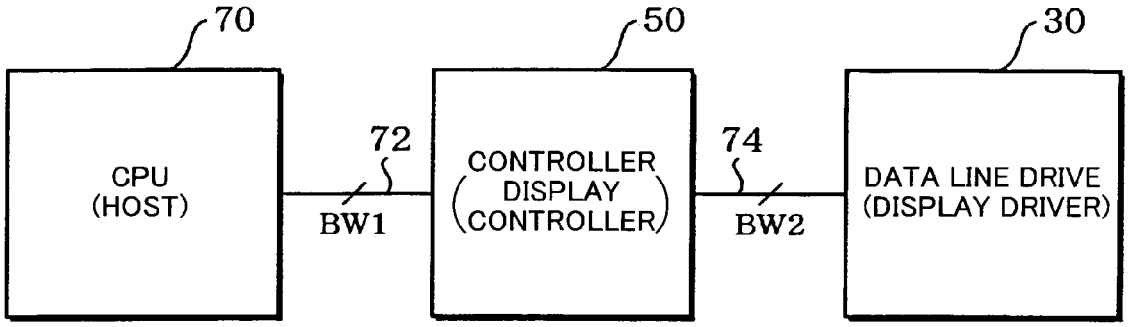
FIG. 2 is a schematic view showing the connective relationship between a host, a controller, and a data line drive circuit of the first embodiment.

The connective relationship between a host, the controller 50, and the data line drive circuit 30 is shown in FIG. 2. A host (CPU) 70 is connected to the controller 50 by a data bus 72 having a bus width BW1. The host 70 supplies display data and control data through the data bus 72 to the controller 50. The bus width BW1 is determined with reference to the bytes that are the processing units of the CPU. The bus width BW1 could be 8 bits, 16 bits, 32 bits, or 64 bits, by way of example.

The controller 50 is connected to the data line drive circuit 30 by a data bus 74 having a bus width BW2. The controller 50 supplies display data and command data corresponding to control details of the data line drive circuit 30 through the data bus 74 to the data line drive circuit 30. The bus width BW2 is determined with reference to the number of grayscale levels of each of an R color component (a first color component), a G color component (a second color component), and a B color component (a third color component). The bus width BW2 could be 18 bits (where grayscale data for each color component is 6 bits) or 24 bits (where grayscale data for each color component is 8 bits), by way of example.

Thus, the bus width of the data bus 72 connected to the general-purpose host 70 differs from the bus width of the data bus 74 connected to the data line drive circuit 30, which is optimized for grayscale display. This means that the data transfer efficiency from the host 70 to the data line drive circuit 30 is bad.

Since the general-purpose controller 50 is not provided with command data input-output functions for controlling the data line drive circuit 30, on the other hand, it is not possible to control the data line drive circuit 30 efficiently.

With the first embodiment, if the data bus width that can be output by the controller 50 differs from the data bus width that can be input to the data line drive circuit 30, and if the data bus width that can be output by the controller 50 (such as 18 bits) is greater than the data bus width that can be input to the data line drive circuit 30 (such as 16 bits), the surplus bus lines can be utilized for supplying command data.

Figure 3:
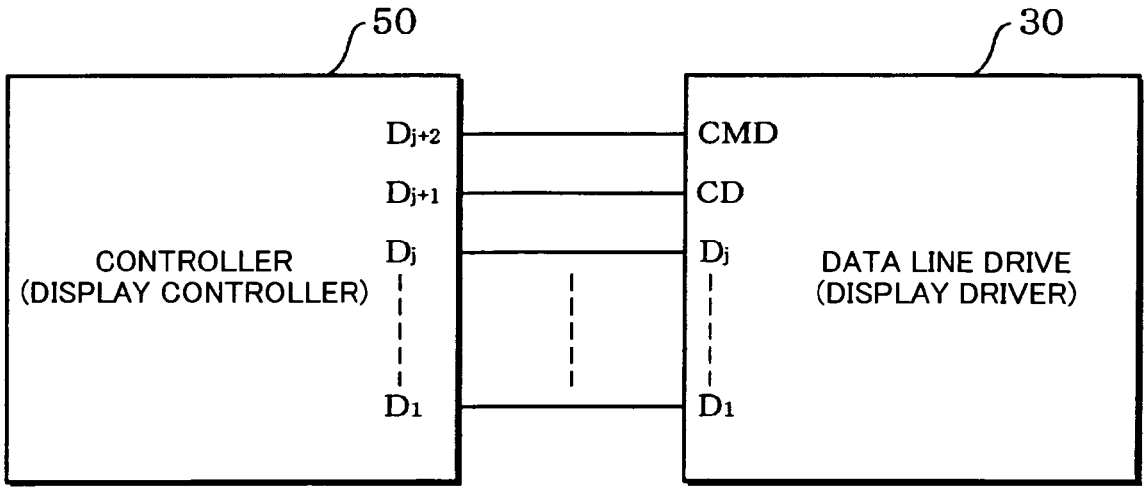
FIG. 3 is a schematic view showing the connective relationship between the controller and the data line drive circuit of a first embodiment the present invention.

The connective relationship between the controller 50 and the data line drive circuit 30 in accordance with the first embodiment is shown schematically in FIG. 3.

When the data line drive circuit 30 drives the data lines, based on display data that has been input in a j-bit unit (where j is a natural number), the controller 50 can output display data in a k-bit unit (where k is an integer such that $k \geqq j+2$). For that reason, the controller 50 has first to (j+2)th data output terminals $D_1$ to $D_{j+2}$ for outputting (j+2) bits of display data, of the display data that is output in a k-bit unit.

Bus lines that are connected to the first to j-th data output terminals $D_1$ to $D_j$ of the controller 50 are connected to first to j-th data input terminals $D_1$ to $D_j$ of the data line drive circuit 30. A bus line connected to the (j+1)th data output terminal $D_{j+1}$ of the controller 50 is connected to a command data input terminal CD of the data line drive circuit 30. Similarly, a bus line that is connected to the (j+2)th data output terminal $D_{j+2}$ of the controller 50 is connected to a command identification signal input terminal CMD of the data line drive circuit 30.

The controller 50 outputs display data, which includes grayscale data generated by the host, in a k-bit unit or a j-bit unit to the data line drive circuit 30, in synchronization with the display timing. If it outputs the display data in a k-bit unit, the controller 50 outputs (j+2) bits of display data through the first to (j+2)th data output terminals. If it outputs the display data in a j-bit unit, the controller 50 outputs it through the first to j-th data output terminals.

In addition, if the controller 50 outputs the display data in a j-bit unit, it also outputs through the (j+2)th data output terminal $D_{j+2}$ a command identification signal for specifying the position of command data amidst the data that is output through the (j+1)th data output terminal $D_{j+1}$.

Note that the command data in this first embodiment is described at being output as 1-bit-wide serial data, but it could equally well be output as data of a plurality of bits.

The data line drive circuit 30 has the command identification signal input terminal CMD and the command data input terminal CD. Command data is specified by the data line drive circuit 30, based on the command identification signal that is input from the controller 50 through the command identification signal input terminal CMD, from data that has been input to the command data input terminal CD. That command data is decoded by the data line drive circuit 30 and control corresponding to the result of that decoding is performed.

The command data is data corresponding to a command for executing a function such as setting one of the operating modes of the data line drive circuit 30. A command is a partial block selection command for partial driving, an output block selection command, or an output timing setting command, by way of example.

A partial block selection command is a command for selecting individual blocks that are units of pluralities of data lines, for driving the display of data lines by the data line drive circuit 30. A grayscale voltage corresponding to grayscale data synchronized to the display timing is applied to the data lines of a block selected for this display driving by a partial block selection command. For the data lines in blocks that are selected for non-display driving by the partial block selection command, the voltage VCOM supplied to the opposing electrode COM could be applied in such a manner that the transmissivity of the pixels (liquid-crystal elements) connected to the TFTs in those data lines does not change, by way of example.

The output block selection command is a command for selecting either drive-on or drive-off by the data line drive circuit 30, for data lines in individual blocks. A grayscale voltage corresponding to the grayscale data is applied to data lines in a block that has been set to drive-on by the output block selection command, in synchronization with the display timing. The outputs to data lines in a block that has been set to drive-off by the output block selection command are set to a high impedance state.

The output timing setting command is a command for finely setting the output timings to the data lines by the data line drive circuit 30, to ensure reduced power consumptions.

The description now turns to an example of the configuration of this first embodiment.

Figure 4:
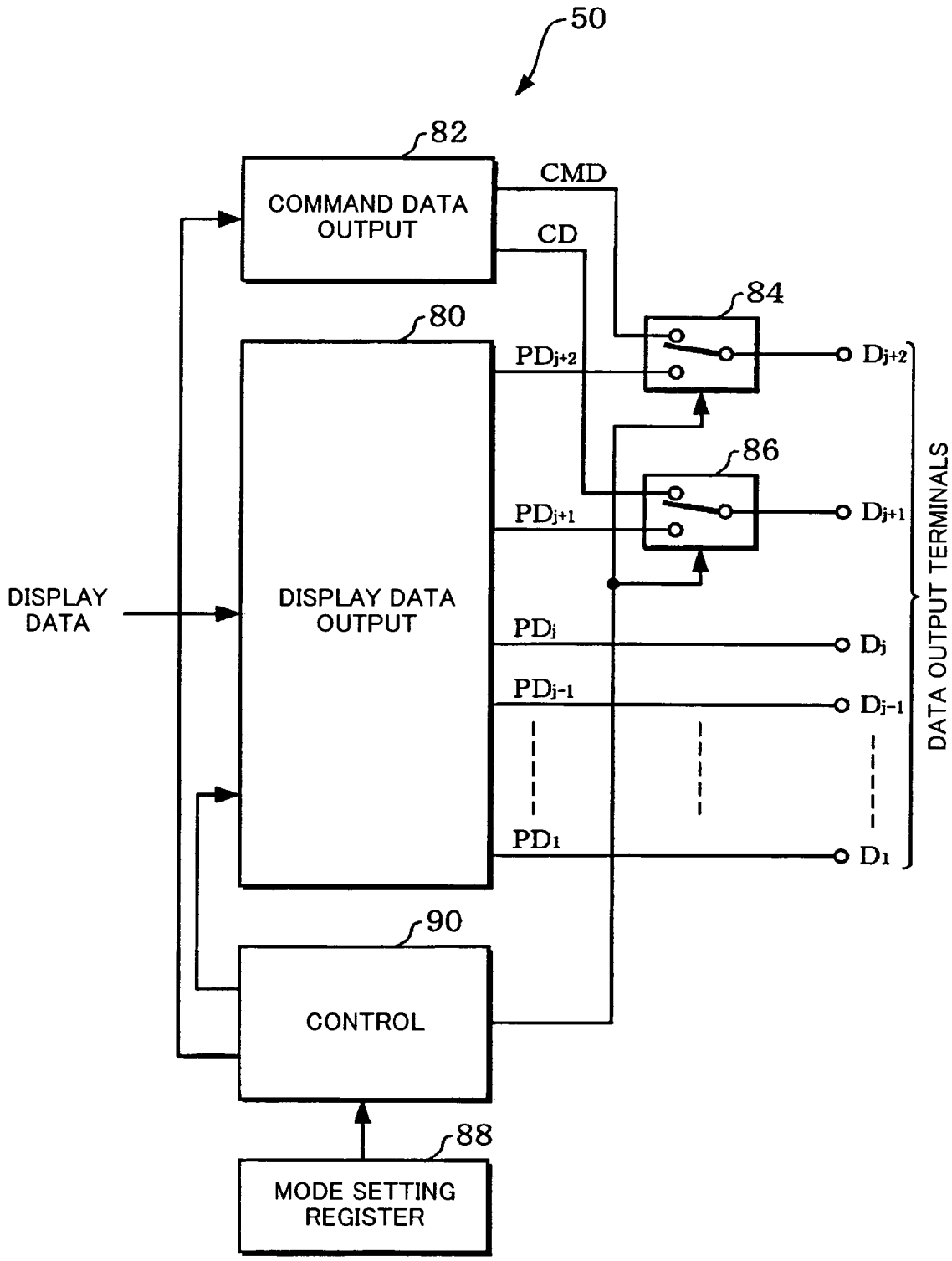
FIG. 4 is a block diagram of an example of the configuration of the controller of the first embodiment.

An example of the configuration of the controller 50 of the first embodiment is shown in FIG. 4. The controller 50 includes a display data output section 80, a command data output section 82, first and second switch output sections 84 and 86, a mode setting register 88, and a control section 90.

The display data output section 80 outputs display data from the host in a k-bit unit or a j-bit unit. The command data output section 82 generates command data corresponding to the control details instructed from the host and a command identification signal for specifying that command data, and outputs it to the data line drive circuit 30, by way of example.

The first switch output section 84 outputs either the command identification signal that has been output by the command data output section 82 or the (j+2)th bit of data of the display data that is output by the display data output section 80, to the (j+2)th data output terminal $D_{j+2}$. This makes it possible to output the command identification signal through the (j+2)th data output terminal $D_{j+2}$ instead of the (j+2)th bit of the display data.

The second switch output section 86 outputs either the command data that has been output by the command data output section 82 or the (j+1)th bit of display data that is output by the display data output section 80, to the (j+1)th data output terminal $D_{j+1}$. This makes it possible to output the command data through the (j+1)th data output terminal $D_{j+1}$ instead of the (j+1)th bit of the display data.

The mode setting register 88 is a control register for setting the operating mode of the controller 50 to either a first mode or a second mode, by the host by way of example. The controller 50 provides control corresponding to the mode that has been set in the mode setting register 88.

The control section 90 controls the various parts of the controller 50, including the display data output section 80, the command data output section 82, and the first and second switch output sections 84 and 86, in accordance with the mode that has been set in the mode setting register 88.

If the thus-configured controller 50 has been set to the first mode, (j+2) bits of display data (from the display data that is output in a k-bit unit) is output by the display data output section 80 through the first to (j+2)th data output terminals.

If the controller 50 has been set to the second mode, display data is output through the first to j-th data output terminals in a j-bit unit. In addition, command data is output through the (j+1)th data output terminal and the command identification signal is output through the (j+2)th data output terminal.

Figure 5:
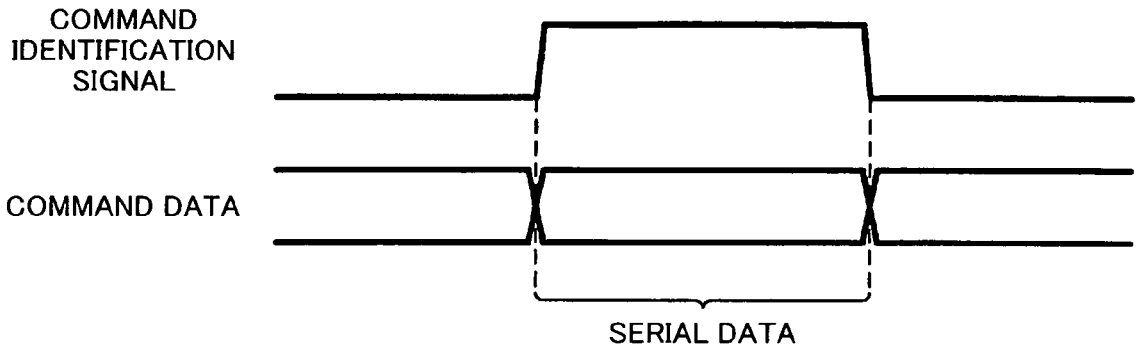
FIG. 5 is a schematic view of the relationship between command data and the command identification signal in accordance with the first embodiment.

The relationship between command data and the command identification signal is shown schematically in FIG. 5. The command data output section 82 is capable of outputting a command identification signal such that the logic level thereof is high during a period corresponding to a valid range (valid positions) of command data that is output as serial data, in order to specify that range.

The number of bits corresponding to one pixel is determined by the grayscale level of each color component. Display data for one pixel includes grayscale data for the R color component, the G color component, and the B color component. If the number of bits of grayscale data for each of the R color component, the G color component, and the B color component is eight, the number of bits of the display data is 24. This would make it possible to represent approximately 16,770,000 different grayscales. Similarly, if the number of bits of grayscale data for each of the R color component, the G color component, and the B color component is six, the number of bits of the display data is 18. This would make it possible to represent approximately 260,000 different grayscales.

In the first mode, assume that display data that is output from the controller 50 to the data line drive circuit 30 consists of grayscale data for the R color component, the G color component, and the B color component. In such a case, it is preferable that there is the same number of bits of grayscale data for each of the R color component, the G color component, and the B color component in the display data that is output in a k-bit unit. This is because it is preferable that the general-purpose controller 50 can supply the data line drive circuit with display data that has the same number of bits of grayscale data for each of the R color component, the G color component, and the B color component.

In the second mode, on the other hand, there could be a different number of bits for at least one set of grayscale data, out of the grayscale data for the R color component, the G color component, and the B color component in the display data that is output in a k-bit unit to the data line drive circuit 30.

In the configuration shown in FIG. 2, the display data from the host 70 to the controller 50 is often supplied in 8-bit, 16-bit, 32-bit, or 64-bit units. For that reason, the transfer efficiency of 24-bit or 18-bit display data can decrease. In such a case, the data line drive circuit 30 can set the number of bits per pixel in the display data to 16 bits, to implement grayscale representation of approximately 65,000 levels, in order to enable a certain amount of grayscale representation and also increase the transfer efficiency.

In such a case, it is preferable to set the number of bits of grayscale data for the R color component to 5, the number of bits of grayscale data for the G color component to 6, and the number of bits of grayscale data for the B color component to 5, from consideration of the way that human eyes are more sensitive to changes in the G color component, if there are changes in hue.

In this case, the controller 50 could have 18 (=j+2) data output terminals, in order to utilize the processing in 1-pixel, 18-bit units more generally. Since there are 16 (=j) data input terminals of the data line drive circuit 30, on the other hand, the remaining two terminals are used for the output of command data, as described above. This makes it possible to control the data line drive circuit 30 by commands, even with a general-purpose controller.

The description now turns to an example of the configuration of the data line drive circuit 30.

Figure 6:
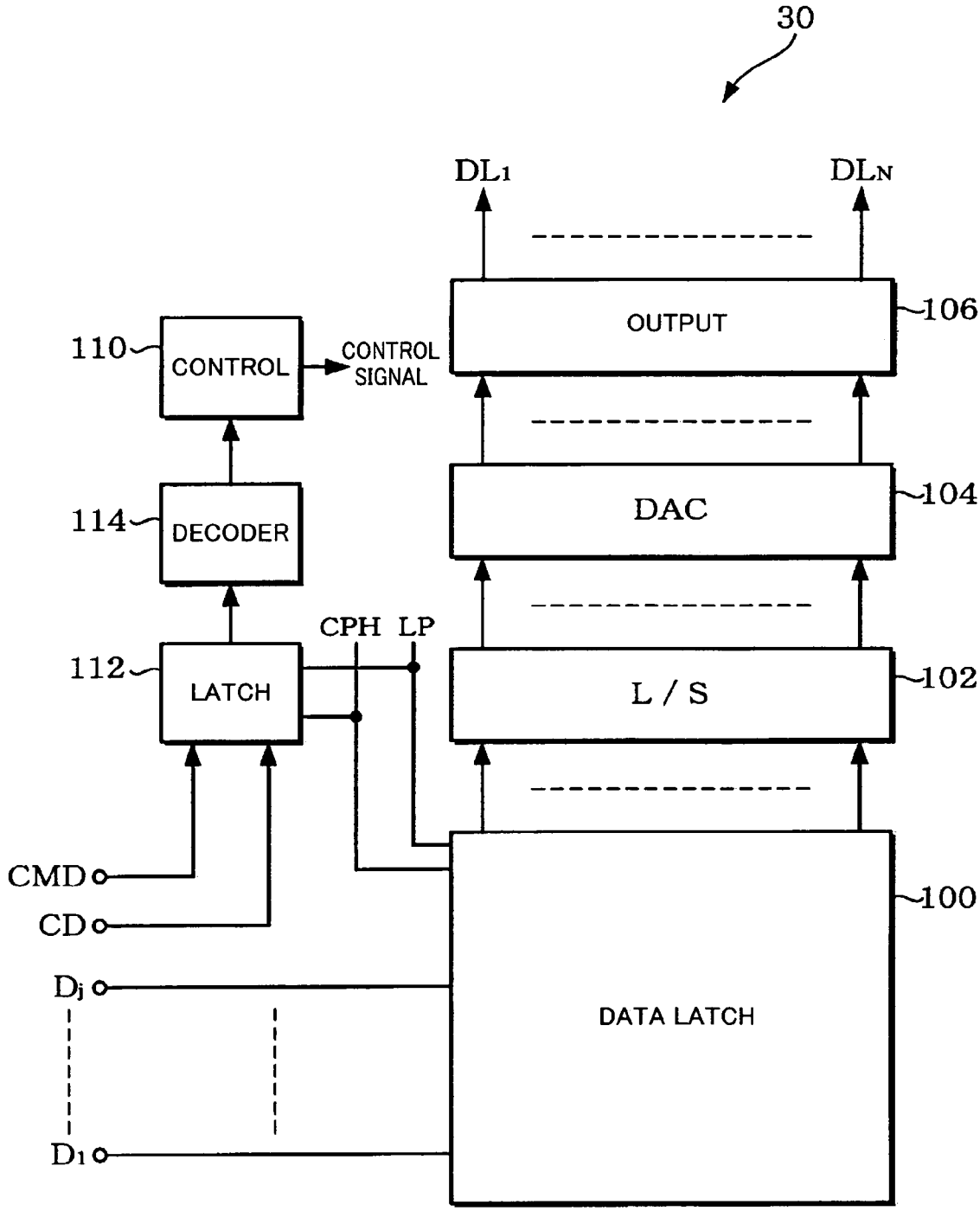
FIG. 6 is a block diagram of an example of the configuration of the data line drive circuit of the first embodiment.

An example of the configuration of the data line drive circuit 30 of the first embodiment is shown in FIG. 6. The data line drive circuit 30 includes a data latch 100, a level shifter (L/S) 102, a voltage selection circuit (digital-to-analog converter: DAC) 104, and an output circuit 106.

The data latch 100 latches display data that has been input through the first to j-th data input terminals $D_1$ to $D_j$. The display includes a plurality of grayscale data items in which grayscale data is divided for individual data lines.

The L/S 102 shifts the output voltages of the data latch 100.

The DAC 104 outputs analog grayscale voltages that correspond to the data from the L/S 102, from among a plurality of reference voltages where each reference voltage corresponds to grayscale data. More specifically, the DAC 104 decodes the grayscale data and selects one of the reference voltages, based on the decoding result. The reference voltage selected by the DAC 104 is output to the output circuit 106 as an analog grayscale voltage.

The output circuit 106 drives the data lines $DL_1$ to $DL_N$ based on the analog grayscale voltages from the DAC 104. The output circuit 106 can also perform partial drive and output selection for individual blocks in units of a plurality of data lines. Partial drive control uses the above-mentioned partial block selection command. Output selection control uses the above-mentioned output block selection command. In response to such commands, a voltage corresponding to grayscale data or the common electrode voltage VCOM (or substantially the same voltage) is applied to the data lines in each block. Alternatively, the output to the data lines in each block could be set to a high impedance state in response to a command.

Figure 7:
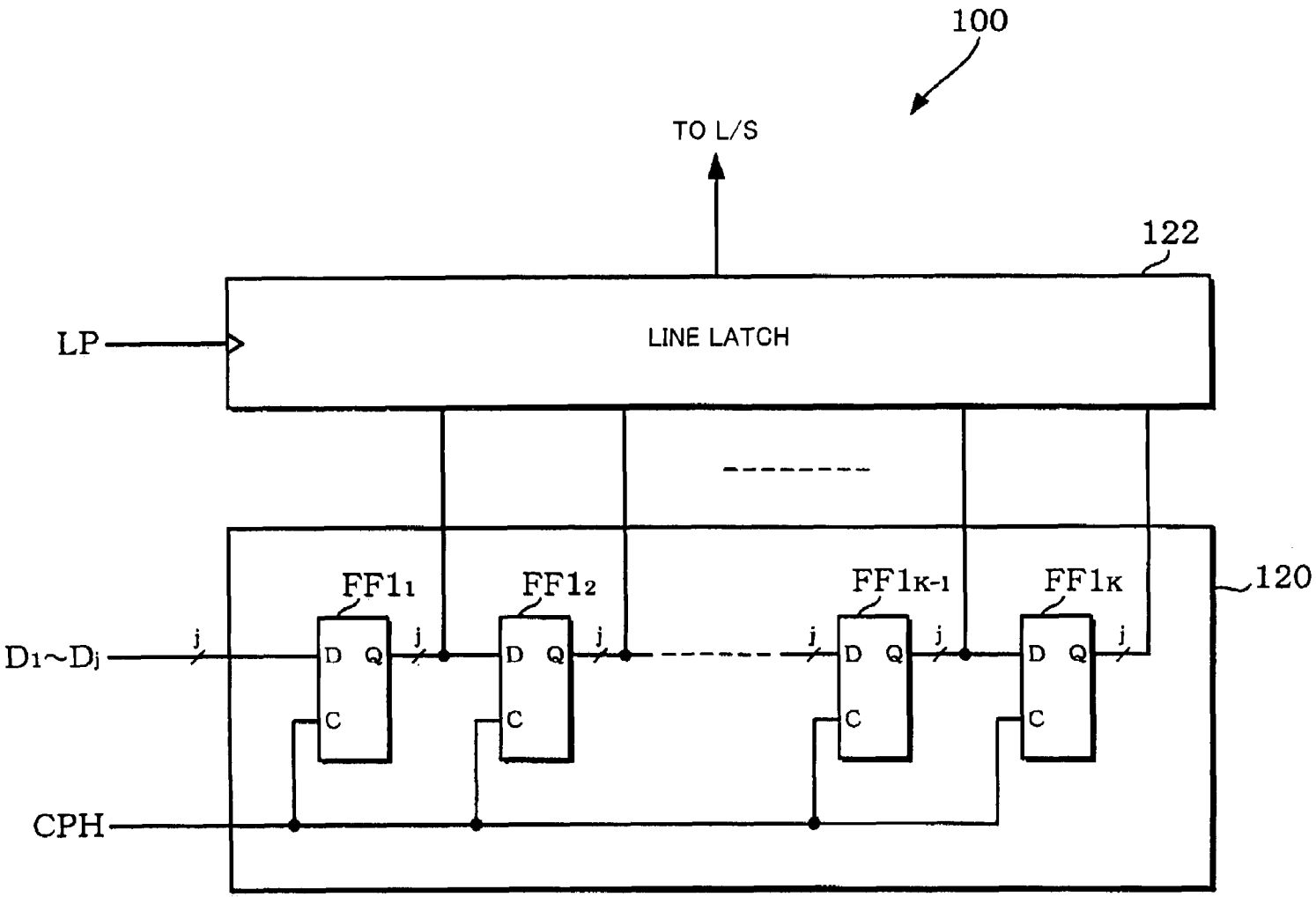
FIG. 7 is a block diagram of an example of the configuration of the data latch of the first embodiment.

An example of the configuration of the data latch 100 is shown in FIG. 7. The data latch 100 includes a shift register 120 and a line latch 122.

The shift register 120 has first to K-th flip-flops $FF1_1$ to $FF1_K$ (where K is an integer of at least two digits). A flip-flop $FF1_{i1}$ (where i1 is an integer such that $1 \leqq i1 \leqq K$) has a clock terminal C, an input terminal D, and an output terminal Q. The flip-flop $FF1_{i1}$ holds a data signal at the input terminal D at the rise of an input signal at the clock terminal C, and outputs the thus-held data signal from the output terminal Q.

Each flip-flop can hold one or a plurality of bits of grayscale data created in data line units. The output of the i-th flip-flop (where i is an integer such that $1 \leqq i \leqq K-1$) is connected to the input of the (i+1)th flip-flop $FF1_{i+1}$. Input data that has been input to the first flip-flop $FF1_1$ is shifted in synchronization with a shift clock CPH.

In this case, the shift clock CPH is a pulse signal used for fetching display data that is input in pixel units, during a horizontal scan period regulated by the period of a latch pulse LP.

The line latch 122 fetches shift data that has been held in the first to K-th flip-flops $FF1_1$ to $FF1_K$ of the shift register. The data fetched into the line latch 122 is output to the L/S 102.

The above-described configuration makes it possible to fetch display data that is input in a j-bit unit for each pixel, in synchronization with the shift clock CPH, and hold it as display data for one horizontal scan period.

The voltage level is then shifted by the L/S 102 and is output to the output circuit 106 as an analog grayscale voltage by the DAC 104.

Control of the thus-configured data line drive circuit 30 is based on a control signal that is output from a control section 110. This control signal could be a block selection signal for partial drive or a drive-on or drive-off block selection signal. The control section 110 outputs a control signal corresponding to the command data specified by the command identification signal that is input through the command identification signal output pin CMD, from the data that is input through the command data input terminal CD.

In order to generate the above-described control signal, the data line drive circuit 30 could include a latch 112 and a decoder 114.

The latch 112 fetches command data, based on the command identification signal. The command data and the command identification signal in this case are in the timing relationship shown in FIG. 5.

The decoder 114 decodes the command data that has been fetched into the latch 112. The control section 110 outputs a control signal corresponding to the result of the decoding by the decoder 114.

Figure 8:
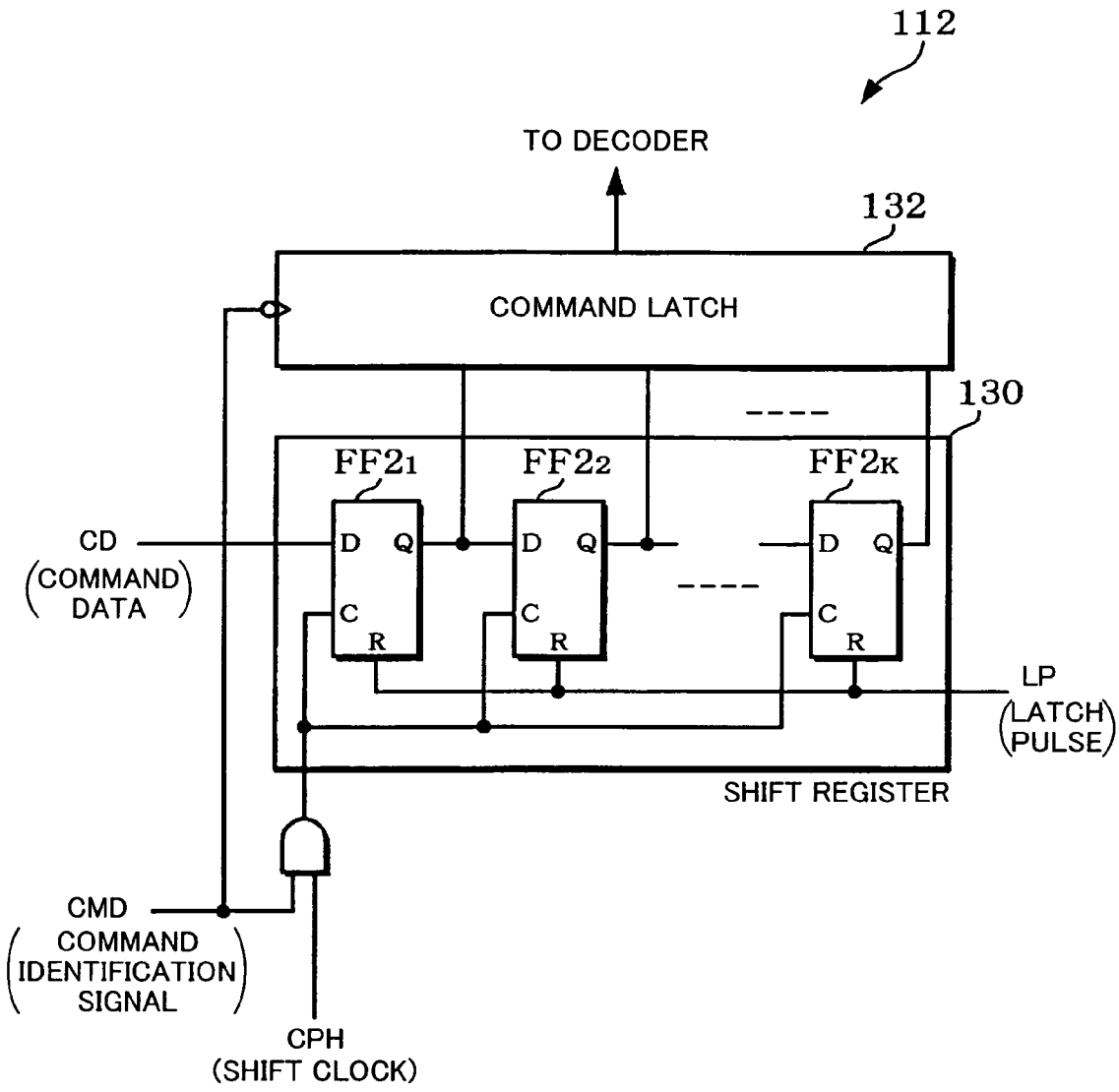
FIG. 8 is a block diagram of an example of the configuration of the latch of the first embodiment.

An example of the configuration of the latch 112 is shown in FIG. 8. The latch 112 could include a shift register 130 and a command latch 132.

The shift register 130 has first to K-th flip-flops $FF2_1$ to $FF2_K$. A flip-flop $FF2_{i1}$ has a clock terminal C, an input terminal D, an output terminal Q, and a reset terminal R. The flip-flop $FF2_{i1}$ holds a data signal at the input terminal D at the rise of an input signal at the clock terminal C, and outputs the thus-held data signal from the output terminal Q. The internal state of the flip-flop $FF2_{i1}$ is returned to an initial state by an input signal to the reset terminal R. Each flip-flop can hold one bit of grayscale data created in data line units (or a plurality of bits if the command data that is input from the command data input terminal CD has a plurality of bits). The output of the i-th flip-flop $FF2_i$ is connected to the input of the (i+1)th flip-flop $FF2_{i+1}$. Command data (CD) that has been input to the first flip-flop $FF2_1$, is shifted in synchronization with a command shift clock. This command shift clock is a signal obtained by ANDing the shift clock CPH and the command identification signal.

In other words, command data is data that has been input by shifting input data in synchronization with the shift clock CPH when the logic level of the command identification signal is high.

Note that each flip-flop is reset by the latch pulse LP.

The command latch 132 latches the command data held in the first to K-th flip-flops $FF2_1$ to $FF2_K$, in synchronization with the fall of the command identification signal. The command data latched in the command latch 132 is output to the decoder 114.

Figure 9:
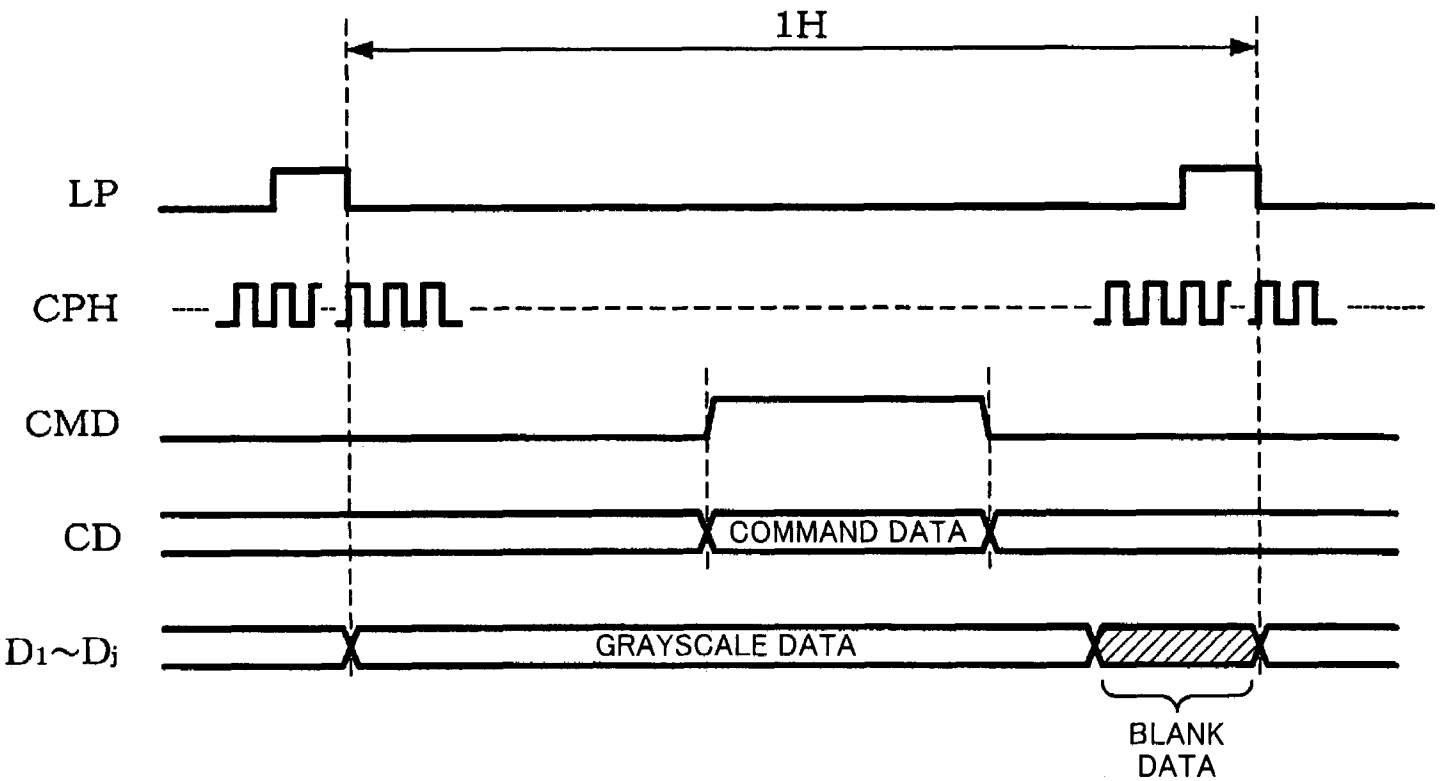
FIG. 9 is a timing chart of an example of the operational timing of the data line drive circuit of the first embodiment.

An example of the operational timings of the controller 50 and the data line drive circuit 30 of the first embodiment is shown in FIG. 9. In this case, assume that the controller 50 has been set to the second mode. In other words, the controller 50 can output display data in the original k-bit unit, but it can also output display data in a j-bit unit, while outputting command data and a command identification signal through the remaining data output terminals.

Grayscale data corresponding to each data line is output from the first to j-th data output terminals $D_1$ to $D_j$ of the controller 50 to the data line drive circuit 30 within one horizontal scan period (1H), as display data that has been time-division multiplexed. In FIG. 9, the above-described multiplexed data and blank data is input within 1H. The blank data is dummy data that is embedded by the controller 50 and is data that does not affect control by the display and command data.

Similarly, the command identification signal is output from the (j+2)th data output terminal $D_{j+2}$ of the controller 50 and the command data is output from the (j+1)th data output terminal $D_{j+1}$ thereof.

When the logic level of the command identification signal that is input through the command identification signal output pin CMD is low, the data line drive circuit 30 ignores the command data that is input through the command data input terminal CD. When the logic level of the command identification signal is high, on the other hand, the command data that has been input through the command identification signal input terminal CMD is fetched into the latch 112 of FIG. 6 and is used for control within the next horizontal scan period, by way of example. In other words, the control section 110 uses the decoder 114 to decode command data in the first horizontal scan period. The control section 110 can perform control in the second horizontal scan period, which is the next horizontal scan period after the first horizontal scan period, based on the control signal corresponding to the command data decoded during the first horizontal scan period.

In this case, the decoder 114 preferably does the decoding in synchronization with a signal of a frequency higher than that of the latch pulse LP, such as the shift clock CPH. This enables the output of the decoding result within the horizontal scan period in which the command data has been fetched, making it easy to generate a control signal corresponding to that decoding result before the next horizontal scan period.

Figure 10:
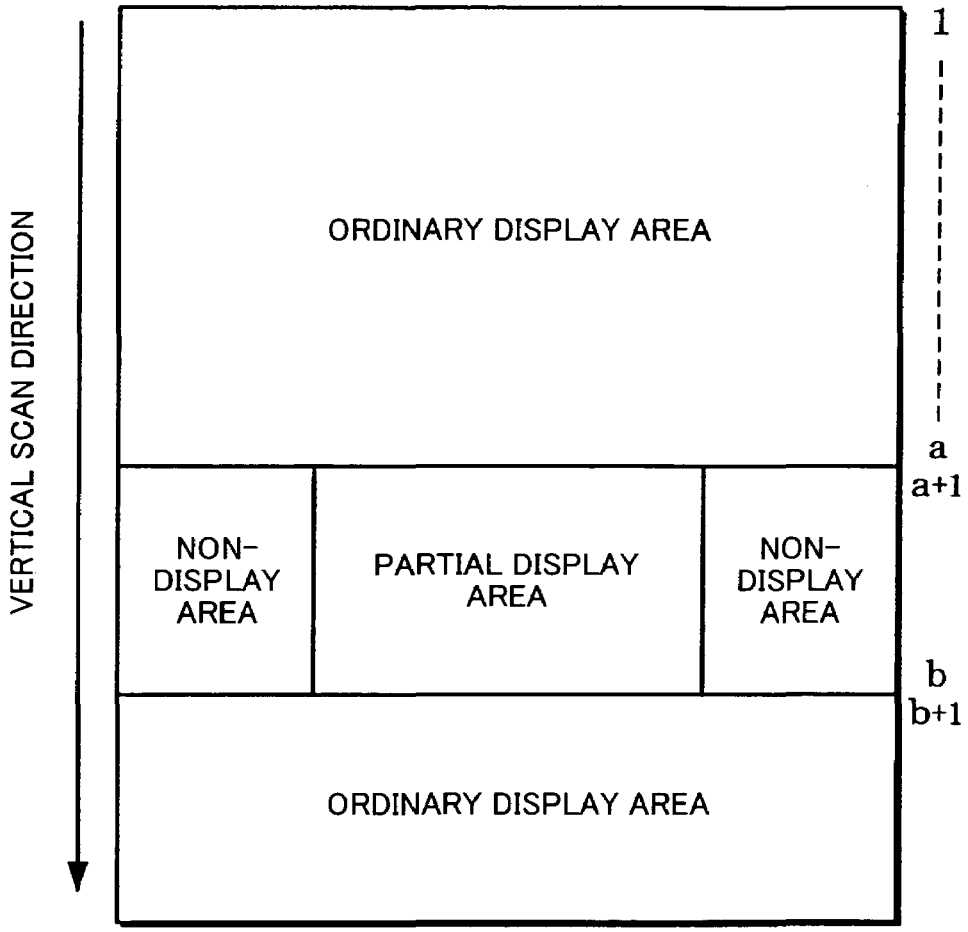
FIG. 10 is illustrative of an example of control by a partial block selection command in accordance with the first embodiment.

An illustrative view of an example of the control by a partial block selection command in accordance with the first embodiment is shown in FIG. 10. In this case, the display area of the liquid-crystal panel 20 that is scanned within one vertical scan period is shown schematically.

Assume that the scan lines selected for each horizontal scan period are scanned one-by-one in the sequence of: first line, second line, . . . first line. In FIG. 10, ordinary drive is done from the first line to the a-th line (where a is an integer). In other words, grayscale voltages corresponding to the grayscale data are applied by the data line drive circuit 30 to the data lines $DL_1$ to $DL_N$.

In this case, assume that a partial block selection command is input during the horizontal scan period for the a-th line at the timing shown in FIG. 9. In such a case, data is fetched into the latch 112 within that horizontal scan period and, as a result, it is determined to be a partial block selection command by the decoder 114. Control in the horizontal scan period for the (a+1)th line, which is the next horizontal scan period, is based on that partial block selection command. In such a case, grayscale voltages corresponding to the grayscale data synchronized to the display timing are applied to the data lines of the first block selected for the display drive. For the data lines of the second and third blocks that have been selected for non-display drive by the partial block selection command, a voltage such as the voltage VCOM supplied to the opposing electrode COM, or substantially the same voltage, is applied to ensure that there is no change in the transmissivity of the pixels (liquid-crystal elements) connected to the TFTs in those data lines.

This ensures that the display area corresponding to the first block is a partial display area in which display is in accordance with the grayscale data. In contrast thereto, the display areas corresponding to the second and third blocks are partial non-display areas in which display is a background color of white or black.

If the setting is such that all blocks are subjected to display drive by the partial block selection command in the horizontal scan period for the b-th line (where b is an integer such that b>a+1), the control is such that ordinary display drive returns, starting from the horizontal scan period for the (b+1)th line, which is the next horizontal scan period As described above, the first embodiment ensures that a command identification signal and command data are output instead of display data through two data output terminals of the controller 50 that can output display data in the original k-bit unit. The host can transfer to the controller 50 a command identification signal and command data as data for one frame that is handled in a similar manner as display data, by way of example. The configuration could be such that the command identification signal and command data is output in synchronization with the grayscale data, in the timing shown in FIG. 9. This makes it possible to use a general-purpose controller 50 to control the data line drive circuit 30 which is controlled by commands.

2. Second Embodiment

In the first embodiment, the controller caused the output of the command identification signal and command data through data output terminals that are supposed to be used for grayscale data, but the present invention is not limited thereto. In a second embodiment of the present invention, the controller outputs only the command identification signal through a data output terminal that is supposed to be used for grayscale data, and causes the output of multiplexed command data and grayscale data.

Figure 11:
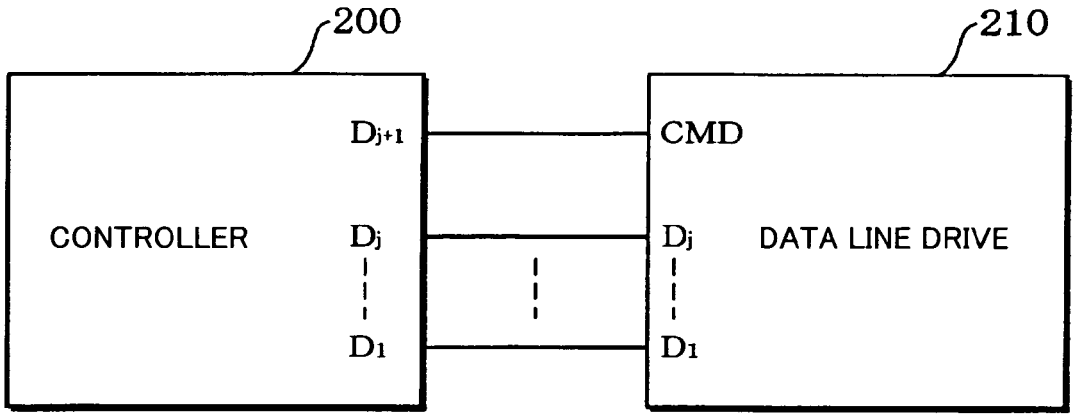
FIG. 11 is a schematic view of the connective relationship between a controller and a data line drive circuit of a second embodiment of the present invention.

The connective relationship between a controller and a data line drive circuit in accordance with this second embodiment is shown schematically in FIG. 11. A controller 200 and a data line drive circuit 210 of the second embodiment can be applied to a liquid-crystal device of the configuration shown in FIG. 1, instead of the controller 50 and the data line drive circuit 30 of the first embodiment.

When the data line drive circuit 210 drives the data lines, based on display data that has been input in a j-bit unit (where j is a natural number), the controller 200 can output display data in a k1-bit unit (where k1 is an integer such that $k1 \geqq j+1$). For that reason, the controller 200 has first to (j+2)th data output terminals $D_1$ to $D_{j+1}$ for outputting (j+1) bits of display data, of the display data that is output in a k-bit unit.

Bus lines that are connected to the first to j-th data output terminals $D_1$ to $D_j$ of the controller 200 are connected to first to j-th data input terminals $D_1$ to $D_j$ of the data line drive circuit 210. A bus line connected to the (j+1)th data output terminal $D_{j+1}$ of the controller 200 is connected to a command identification signal input terminal CMD of the data line drive circuit 210.

The controller 200 outputs display data, which includes grayscale data generated by the host, in a k1-bit unit or a j-bit unit to the data line drive circuit 210, in synchronization with the display timing. If it outputs the display data in a k1-bit unit, the controller 200 outputs (j+1) bits of display data through the first to (j+1)th data output terminals. If it outputs the display data in a j-bit unit, the controller 200 outputs it through the first to j-th data output terminals.

In addition, if the controller 200 outputs the display data in a j-bit unit, it also outputs through the (j+1)th data output terminal $D_{j+1}$ a command identification signal for specifying the position of command data.

The data line drive circuit 210 has the command identification signal input terminal CMD. Command data is specified by the data line drive circuit 210, based on the command identification signal from multiplexed data that has been time-division multiplexed from the grayscale data through the first to j-th data input terminals $D_1$ to $D_j$ and the command data. The command identification signal is input from the controller 200 through the command identification signal input terminal CMD. That command data is decoded by the data line drive circuit 210 and control corresponding to the result of that decoding is performed.

The description now turns to an example of the configuration of this second embodiment.

Figure 12:
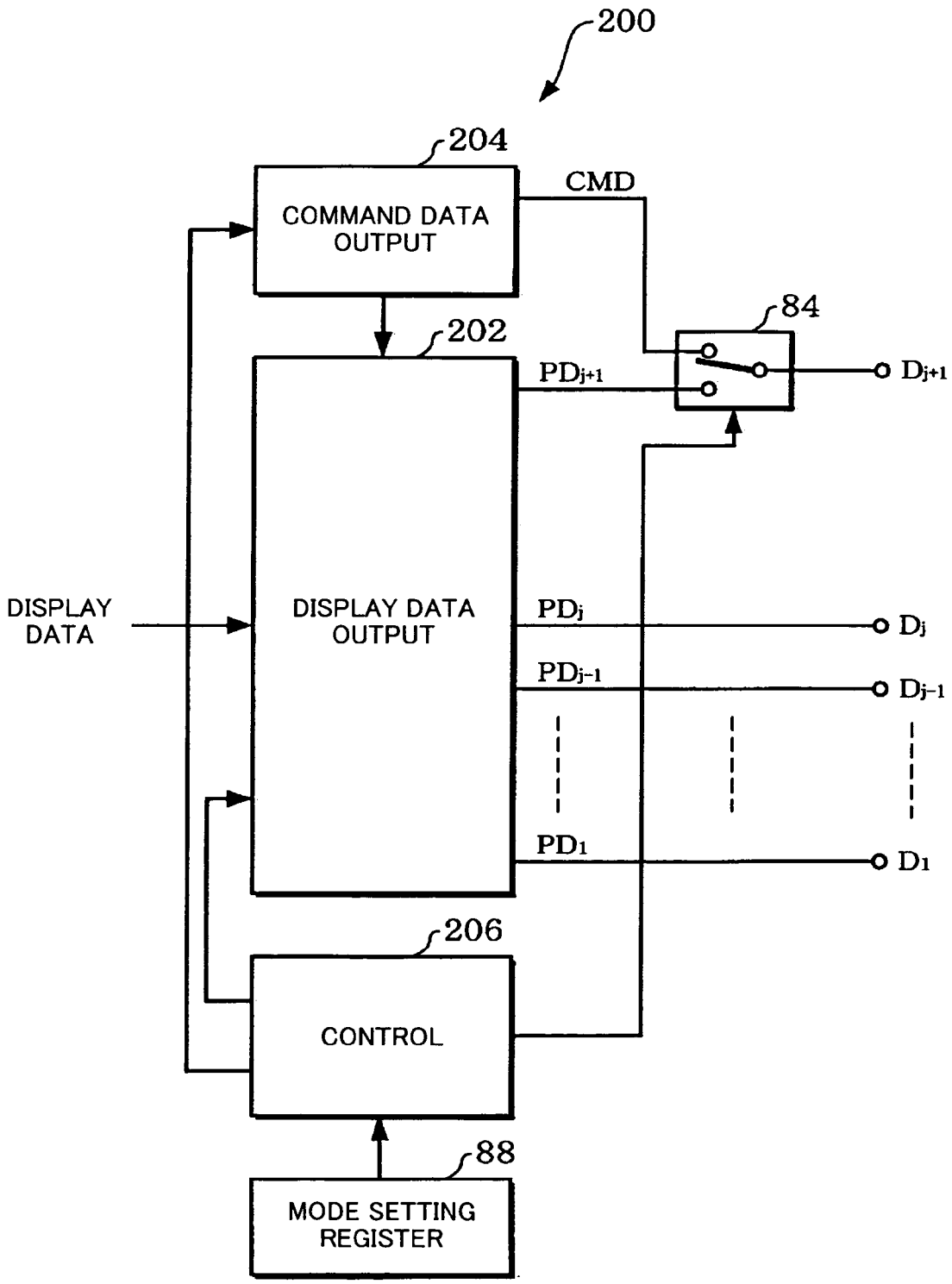
FIG. 12 is a block diagram of an example of the configuration of the controller of the second embodiment.

An example of the configuration of the controller 200 of the second embodiment is shown in FIG. 12. It should be noted that portions that are the same as those in the controller 50 of the first embodiment of FIG. 4 are denoted by the same reference numbers and further description thereof is omitted.

The controller 200 includes a display data output section 202, a command data output section 204, the first switch output section 84, the mode setting register 88, and a control section 206.

The display data output section 202 outputs display data from the host in a k1-bit unit or a j-bit unit. The command data output section 204 generates command data corresponding to the control details instructed from the host and a command identification signal for specifying that command data. Command data is multiplexed together with the grayscale data in the display data output section 202, by way of example, and is output to the data line drive circuit 210. The command identification signal is output to the data line drive circuit 210 from the first switch output section 84, by way of example.

The first switch output section 84 outputs either the command identification signal that has been output by the command data output section 204 or the (j+1)th bit of data of the display data that is output by the display data output section 202, to the (j+1)th data output terminal $D_{j+1}$.

The control section 206 controls the various parts of the controller 200, including the display data output section 202, the command data output section 204, and the first switch output section 84, in accordance with the mode that has been set in the mode setting register 88.

If the thus-configured controller 200 has been set to the first mode, (j+1) bits of display data (from the display data that is output in a k1-bit unit) is output through the first to (j+1)th data output terminals.

If the controller 200 has been set to the second mode, display multiplexed data that has been multiplexed in a time-division manner from the display data and the command data is output through the first to j-th data output terminals in a j-bit unit. In addition, the command identification signal is output through the (j+1)th data output terminal. During this time, the command identification signal is configured to vary in accordance with the time division timing of the command data in the above-described multiplexed data.

Figure 13:
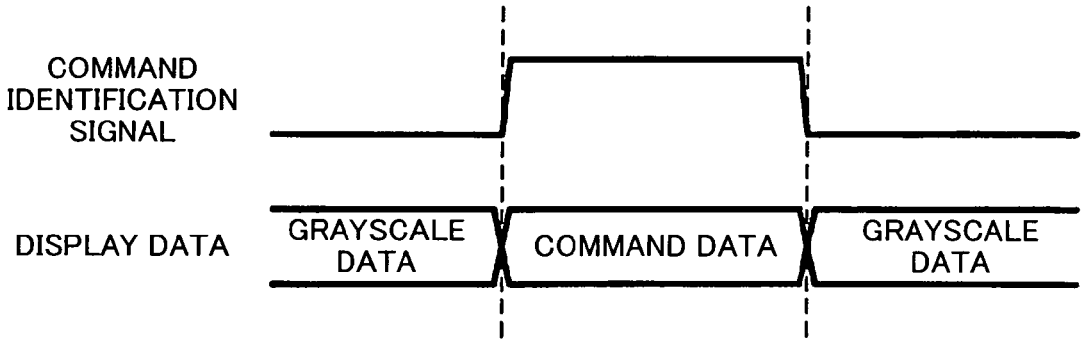
FIG. 13 is a schematic view of the relationship between command data and the command identification signal of the second embodiment.

The relationship between command data and the command identification signal is shown schematically in FIG. 13. The command identification signal is generated to go high during a period corresponding to command data, in order to specify the position of the command data that is multiplexed with the grayscale data.

The description now turns to an example of the configuration of the data line drive circuit 210.

Figure 14:
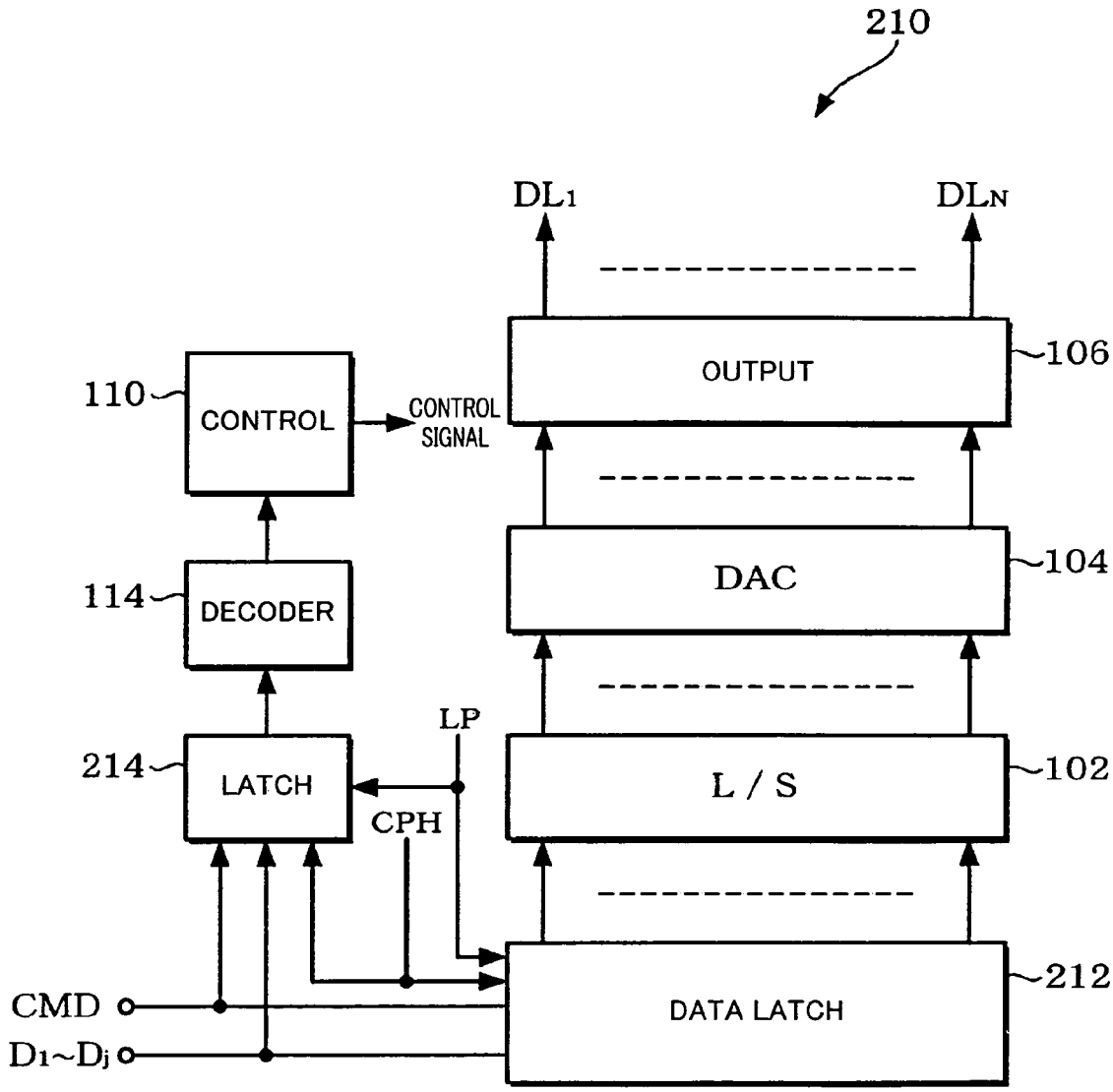
FIG. 14 is a block diagram of an example of the configuration of the data line drive circuit of the second embodiment.

An example of the configuration of the data line drive circuit 210 of the second embodiment is shown in FIG. 14. It should be noted that portions that are the same as those in the data line drive circuit 30 of the first embodiment of FIG. 6 are denoted by the same reference numbers and further description thereof is omitted.

The data line drive circuit 210 includes a data latch 212, the L/S 102, the DAC 104, and the output circuit 106.

The data latch 212 latches display data that is included within the input data that has been input to the first to j-th data input terminals $D_1$ to $D_j$. The display data includes a plurality of grayscale data items in which grayscale data is divided between individual data lines. For example, the data latch 212 could include a shift register, in which each stage of flip-flops holds one or a plurality of bits of grayscale data, and a line latch. In such a case, the display data that has been input to the initial flip-flop (the first stage of flip-flop) of the shift register is shifted and fetched by a shift clock CPH having N clocks, which is at least as many as the number of data lines, within one horizontal scan period regulated by the period of a latch pulse LP. The display data that has been fetched into the shift register in synchronization with the latch pulse LP is held in the line latch.

Control of the thus-configured data line drive circuit 210 is based on a control signal that is output from the control section 110, in a manner similar to that of the first embodiment. This control signal could be a block selection signal for partial drive or a drive-on or drive-off block selection signal, or the like. Thus the control section 110 outputs a control signal corresponding to the command data included in the multiplexed data that is input through the first to j-th data input terminals $D_1$ to $D_j$.

To create the above-described control signal, the data line drive circuit 210 could include a latch 214 and the decoder 114. The latch 214 fetches command data from the input multiplexed data, as specified by the command identification signal.

The multiplexed data in this case is display data and command data which has been time-division multiplexed within one horizontal scan period.

Figure 15:
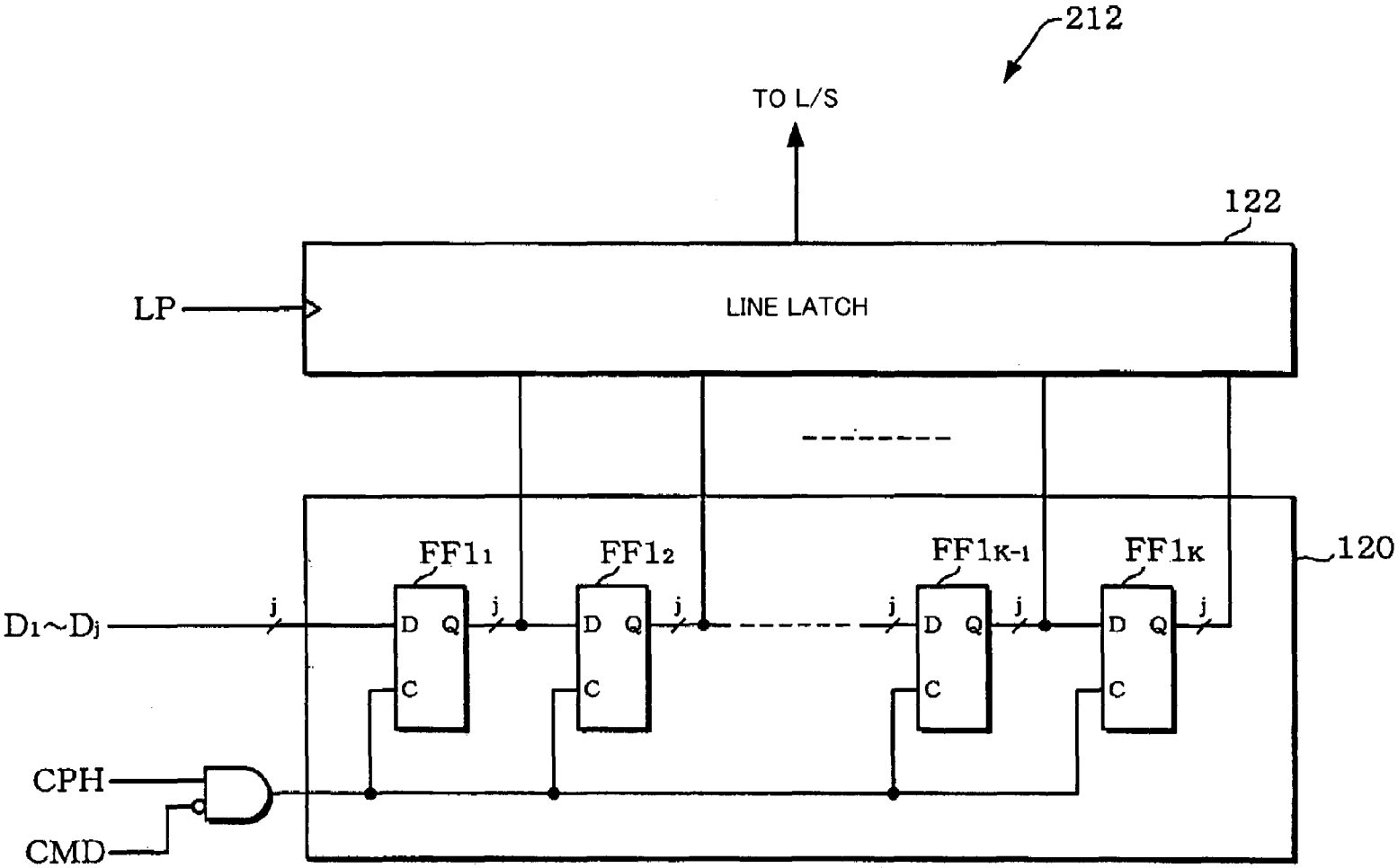
FIG. 15 is a block diagram of an example of the configuration of the data latch of the second embodiment.

An example of the configuration of the data latch 212 is shown in FIG. 15. It should be noted that portions that are the same as those in the data latch 100 of FIG. 7 are denoted by the same reference numbers and further description thereof is omitted.

The data latch 212 differs from the data latch 100 in that the shift clock for the shift register 120 is generated by using the command identification signal. More specifically, the shift clock of the shift register 120 of the data latch 212 is a signal obtained by ANDing the shift clock CPH and an inversion of the command identification signal.

Figure 16:
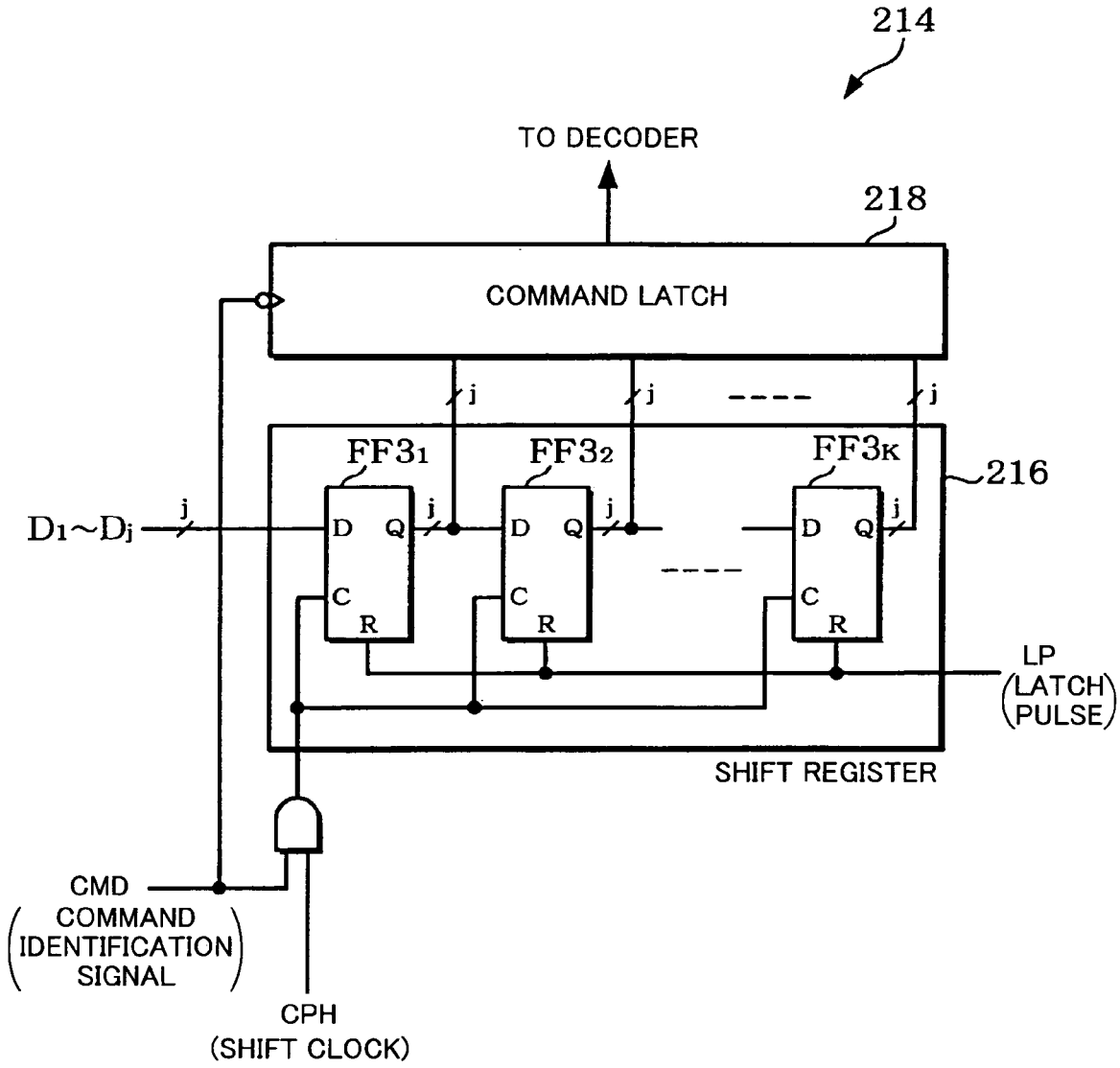
FIG. 16 is a block diagram of an example of the configuration of the latch of the second embodiment.

An example of the configuration of the latch 214 is shown in FIG. 16. The latch 214 could include a shift register 216 and a command latch 218.

The shift register 216 has first to K-th flip-flops $FF3_1$ to $FF3_K$. A flip-flop $FF3_{i1}$ has a clock terminal C, an input terminal D, an output terminal Q, and a reset terminal R. The flip-flop $FF3_{i1}$ holds a data signal at the input terminal D at the rise of an input signal at the clock terminal C, and outputs the thus-held data signal from the output terminal Q. The internal state of the flip-flop $FF3_{i1}$ is returned to the initial state when a signal is input to the reset terminal R.

Each flip-flop can hold j bits of grayscale data created in data line units. The output of the i-th flip-flop $FF3_i$ is connected to the input of the (i+1)th flip-flop $FF3_{i+1}$. j bits of multiplexed data that have been input to the first flip-flop $FF3_1$ are shifted in synchronization with a command shift clock. This command shift clock is a signal obtained by ANDing the shift clock CPH and the command identification signal.

In other words, command data is data that has been input by shifting multiplexed data in synchronization with the shift clock CPH when the logic level of the command identification signal is high. To fetch the grayscale data that is included within the multiplexed data, therefore, the grayscale data is the input data that is shifted and input in synchronization with the shift clock CPH into the data latch 212 of FIG. 15 when the logic level of the command identification signal is low.

Note that each flip-flop is reset by the latch pulse LP.

The command latch 218 latches the command data held in the first to K-th flip-flops $FF3_1$ to $FF3_K$, in synchronization with the fall of the command identification signal. The command data latched in the command latch 218 is output to the decoder 114.

Figure 17:
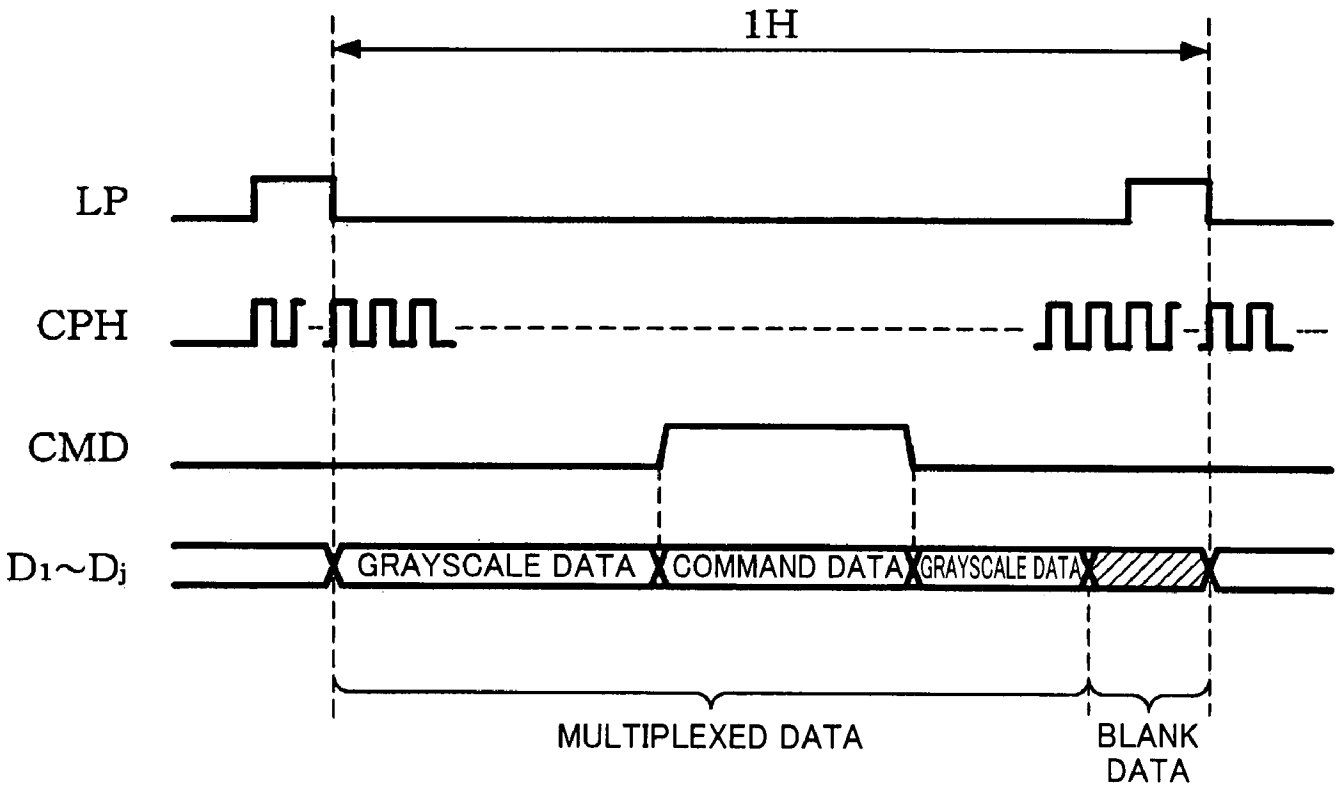
FIG. 17 is a timing chart of an example of the operational timing of the controller and the data line drive circuit of the second embodiment.

An example of the operational timing of the controller 200 and the data line drive circuit 210 of the second embodiment is shown in FIG. 17. In this case, assume that the controller 200 has been set to the second mode. In other words, the controller 200 can output display data in the original k-bit unit, but it can also output display data in a j-bit unit, while outputting command data and a command identification signal through the remaining data output terminals.

Data that is display data (grayscale data) and command data which has been time-division multiplexed within one horizontal scan period (1H) is input to the data line drive circuit 210. In FIG. 17, the above-described multiplexed data and blank data is input within 1H.

When the logic level of the command identification signal is low, the display data in the input data is fetched into the data latch 212 of FIG. 14 and is used for display within the next horizontal scan period, by way of example.

When the logic level of the command identification signal is high, the command data in the input data is fetched into the latch 212 of FIG. 14 and is used for control within the next horizontal scan period, by way of example. In other words, the control section 110 uses the decoder 114 to decode the command data in the first horizontal scan period. The control section 110 can perform control in the second horizontal scan period, which is the next horizontal scan period after the first horizontal scan period, based on the control signal corresponding to the command data decoded during the first horizontal scan period.

As described above, the second embodiment ensures that a command identification signal is output instead of display data through one data output terminal of the controller 200 that can output display data in the original k1-bit unit. The configuration is such that multiplexed command data is output in the display data. In addition to effects similar to those of the first embodiment, this makes it possible to reduce the number of terminals necessary for command control, in comparison with the first embodiment.

Note that it is preferable that the numbers of bits of each color component of the grayscale data of the display data in the first and second modes are the same as those of the first embodiment.

3. Third Embodiment

In comparison with the second embodiment, the third embodiment of the present invention does not use the command identification signal but it enables the input of command data from a general-purpose controller to the data line drive circuit.

Figure 18:
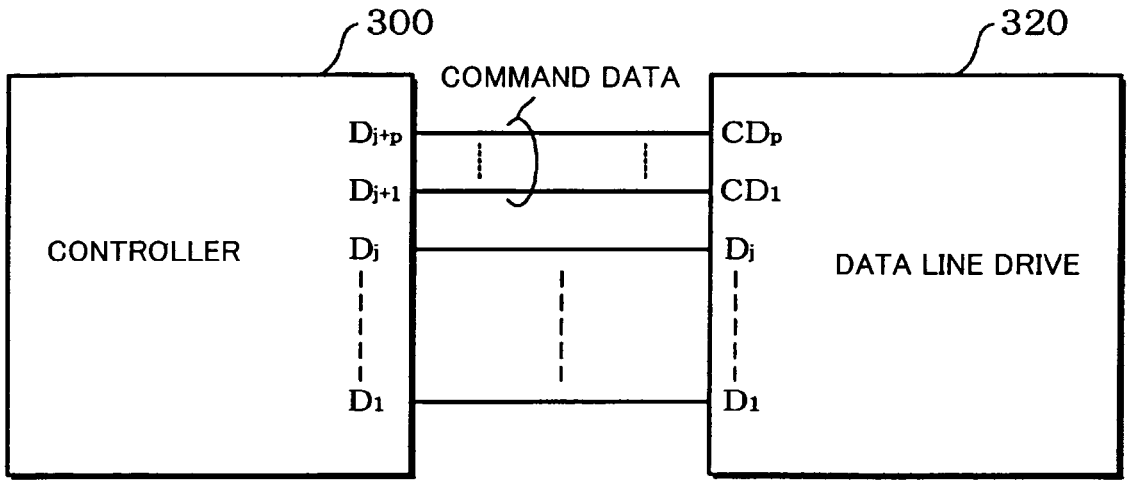
FIG. 18 is a schematic view of the connective relationship between a controller and a data line drive circuit in accordance with a third embodiment of the present invention.

The connective relationship between a controller and a data line drive circuit in accordance with the third embodiment is shown in FIG. 18. A controller 300 and a data line drive circuit 320 of this third embodiment can be applied to the liquid-crystal device of the configuration shown in FIG. 1 instead of the controller 50 and the data line drive circuit 30 of the first embodiment.

When the data line drive circuit 320 drives the data lines, based on display data that has been input in a j-bit unit, the controller 200 can output display data in a k2-bit unit (where k2 and p are positive integers such that $k2 \geqq j+p$). For that reason, the controller 300 has first to (j+p)th data output terminals $D_1$ to $D_{j+p}$ for outputting (j+p) bits of display data, of the display data that is output in a k2-bit unit.

Bus lines that are connected to the first to j-th data output terminals $D_1$ to $D_j$ of the controller 300 are connected to first to j-th data input terminals $D_1$ to $D_j$ of the data line drive circuit 320. Bus lines connected to the (j+1)th to (j+p)th data output terminals $D_{j+1}$ to $D_{j+p}$ of the controller 300 are connected to command data input terminals $CD_1$ to $CD_p$ of the data line drive circuit 320.

The controller 300 outputs display data, which includes grayscale data generated by the host, in a k2-bit unit or a j-bit unit to the data line drive circuit 320, in synchronization with the display timing. If it outputs the display data in a k2-bit unit, the controller 300 outputs (j+p) bits of display data through the first to (j+p)th data output terminals. If it outputs the display data in a j-bit unit, the controller 300 outputs it through the first to j-th data output terminals.

In addition, if the controller 300 outputs the display data in a j-bit unit, it also outputs command data in a p-bit unit through the (j+1)th to (j+p)th data output terminals $D_{j+1}$ to $D_{j+p}$. Note that the timing at which the command data is multiplexed is previously determined between the controller 300 and the data line drive circuit 320.

The data line drive circuit 320 has the command data input terminals $CD_1$ to $CD_p$. Within the data line drive circuit 320, the command data that is input through the command data input terminals $CD_1$ to $CD_p$ is decoded and control corresponding to the result of that decoding is applied.

An example of the configuration of this third embodiment is described below. To simplify the description, p is assumed to be 2 so that command data is output in a 2-bit unit.

Figure 19:
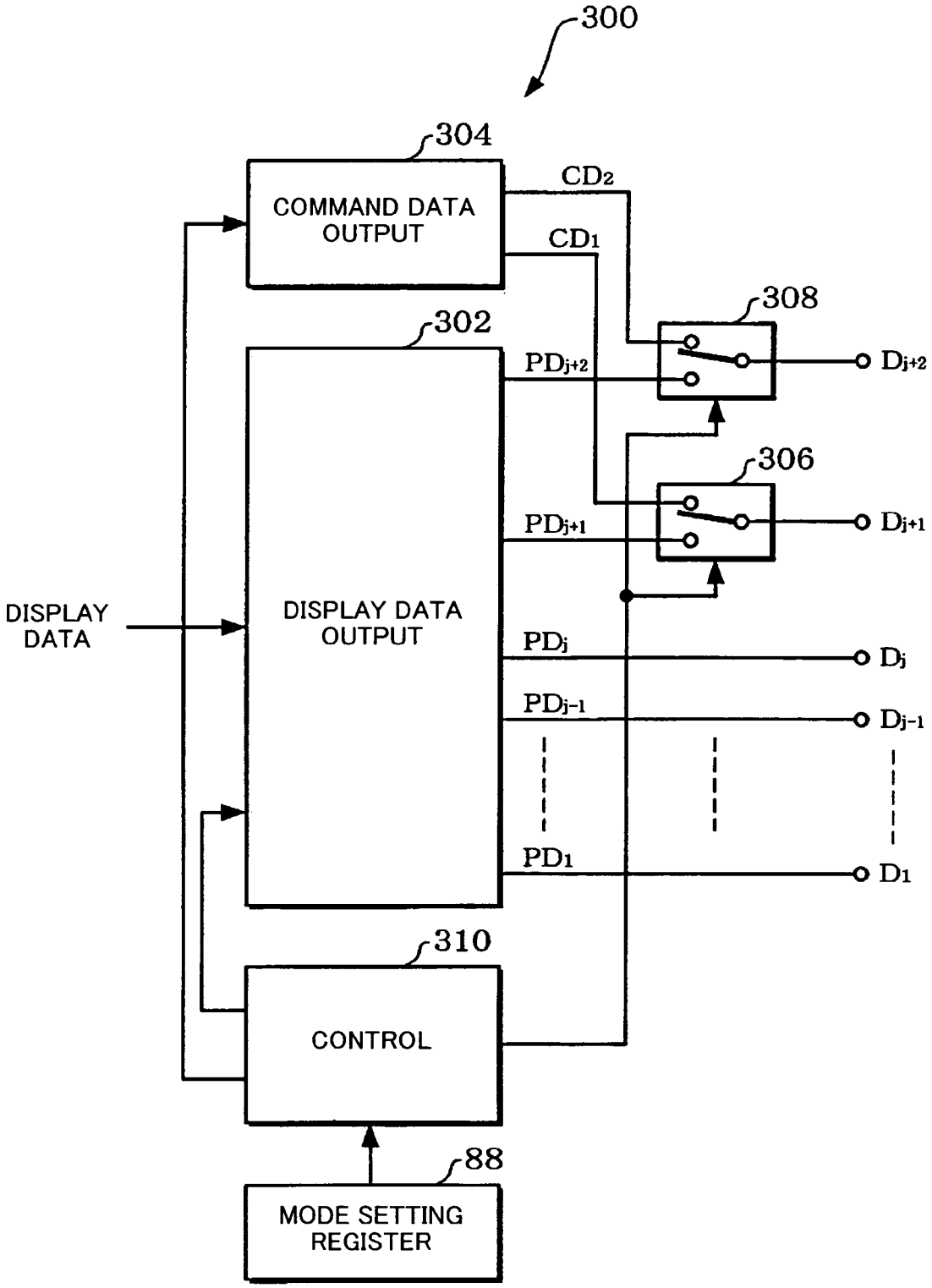
FIG. 19 is a block diagram of an example of the configuration of the controller of the third embodiment.
Figure 20:
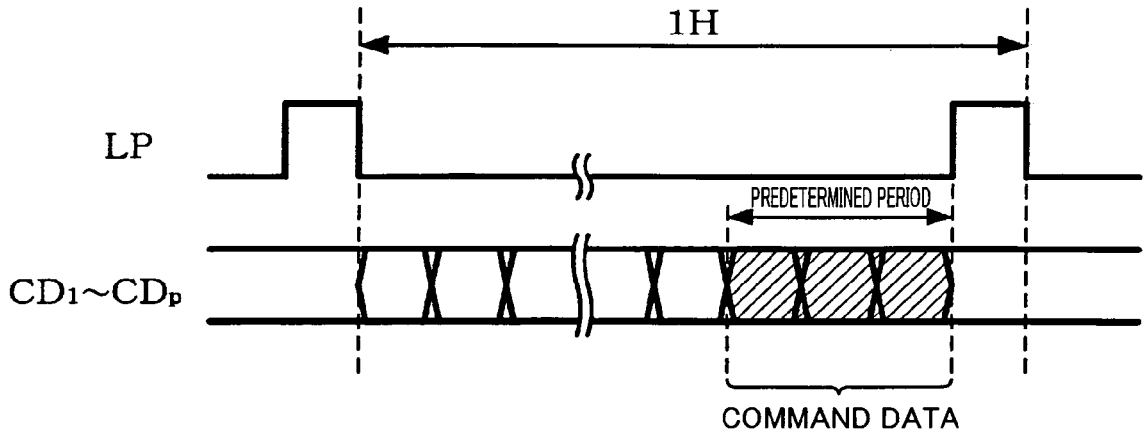
FIG. 20 is a timing chart of an example of command data multiplex timing in accordance with the third embodiment.

An example of the configuration of the controller 300 of the third embodiment is shown in FIG. 19. It should be noted that portions that are the same as those in the controller 200 of the second embodiment of FIG. 12 are denoted by the same reference numbers and further description thereof is omitted.

The controller 300 includes a display data output section 302, a command data output section 304, first and second switch output sections 306 and 308, the mode setting register 88, and a control section 310.

The display data output section 302 outputs display data from the host in a k2-bit unit or a j-bit unit. The command data output section 304 generates command data corresponding to the control data indicated by the host. Command data is output to the data line drive circuit 210 at a previously determined timing within one horizontal scan period, by way of example.

For example, if the configuration is such that the fetch is at the rise of the latch pulse LP that regulates the horizontal scan period, command data can be output in a p-bit unit in the predetermined period immediately before that rise.

The first and second switch output sections 306 and 308 output either the command data $CD_1$ and $CD_2$ that has been output by the command data output section 304 or the (j+1)th and (j+2)th bits of display data that are output by the display data output section 302, to the (j+1)th and (j+2)th data output terminals $D_{j+1}$ and $D_{j+2}$ (when p=2).

The control section 310 controls the various parts of the controller 300, including the display data output section 302, the command data output section 304, and the first and second switch output sections 306 and 308, in accordance with the mode that has been set in the mode setting register 88.

If the thus-configured controller 300 has been set to the first mode, (j+2) bits of display data (from the display data that is output in a k2-bit unit) is output by the display data output section 302 through the first to (j+2)th data output terminals.

If the controller 300 has been set to the second mode, display data is output through the first to j-th data output terminals in a j-bit unit. In addition, command data is output in 2-bit (assuming p=2) units through the (j+1)th and (j+2)th data output terminals.

The data line drive circuit 320 has first to j-th data input terminals $D_1$ to $D_j$ and first to p-th command data input terminals $CD_1$ to $CD_p$. The data line drive circuit 320 drives the data lines on the basis of display data that has been input in a j-bit unit through the first to j-th data input terminals $D_1$ to $D_j$. During this time, command data that has been input through the first to p-th command data input terminals $CD_i$ to $CD_p$ is decoded and control corresponding to the result of the decoding is applied.

The description now turns to an example of the configuration of the data line drive circuit 320 of the third embodiment.

Figure 21:
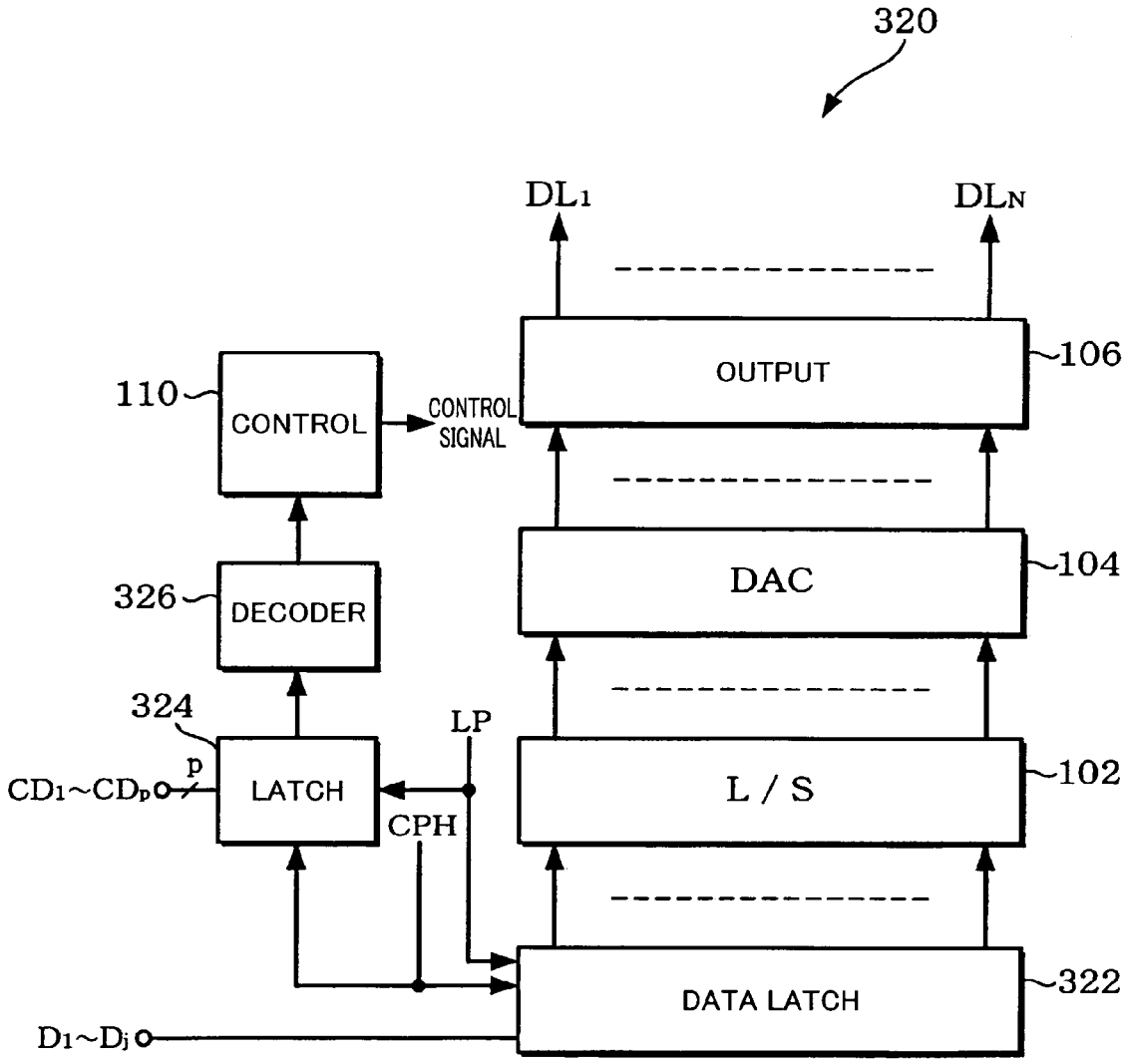
FIG. 21 is a block diagram of an example of the configuration of the data line drive circuit of the third embodiment.

An example of the configuration of the data line drive circuit 320 of the third embodiment is shown in FIG. 21. It should be noted that portions that are the same as those in the data line drive circuit 30 of the first embodiment of FIG. 6 are denoted by the same reference numbers and further description thereof is omitted.

The first point in which the data line drive circuit 320 differs from the data line drive circuit 30 is that it does not have a command identification signal input terminal but it does have the first to p-th command data input terminals $CD_1$ to $CD_p$. The second point in which the data line drive circuit 320 differs from the data line drive circuit 30 is that the configurations of the decoder and data latch are different.

A data latch 322 in accordance with the third embodiment has a plurality of flip-flops, and grayscale data that is input in a j-bit unit through the first to j-th data input terminals $D_1$ to $D_j$ is shifted. Line data for one horizontal line is fetched at the rise of the latch pulse LP.

A latch 324 in accordance with the third embodiment fetches command data in a p-bit unit that is input through the first to p-th command data input terminals $CD_1$ to $CD_p$, in synchronization with the rise of the latch pulse LP. The timing of the input of that command data within one horizontal scan period is previously determined, and the latch 324 fetches the command data that has been input at that timing.

A decoder 326 in accordance with the third embodiment decodes the command data that has been fetched into the latch 324. The command data of the third embodiment is differentiated into execution command data and ordinary command data. Execution command data is command data corresponding to an execution command. Normal command data is command data corresponding to an ordinary command. An execution command is a command that designates whether or not a ordinary command is to be executed. An ordinary command is a command corresponding to previously determined control details, for executing various types of control over the data line drive circuit 320. Thus, when the part of the command data that has been fetched into the latch 324 is execution command data, the data line drive circuit 320 performs control corresponding to the ordinary command data at a position other than that of that command data.

This point is discussed below.

Figure 22:
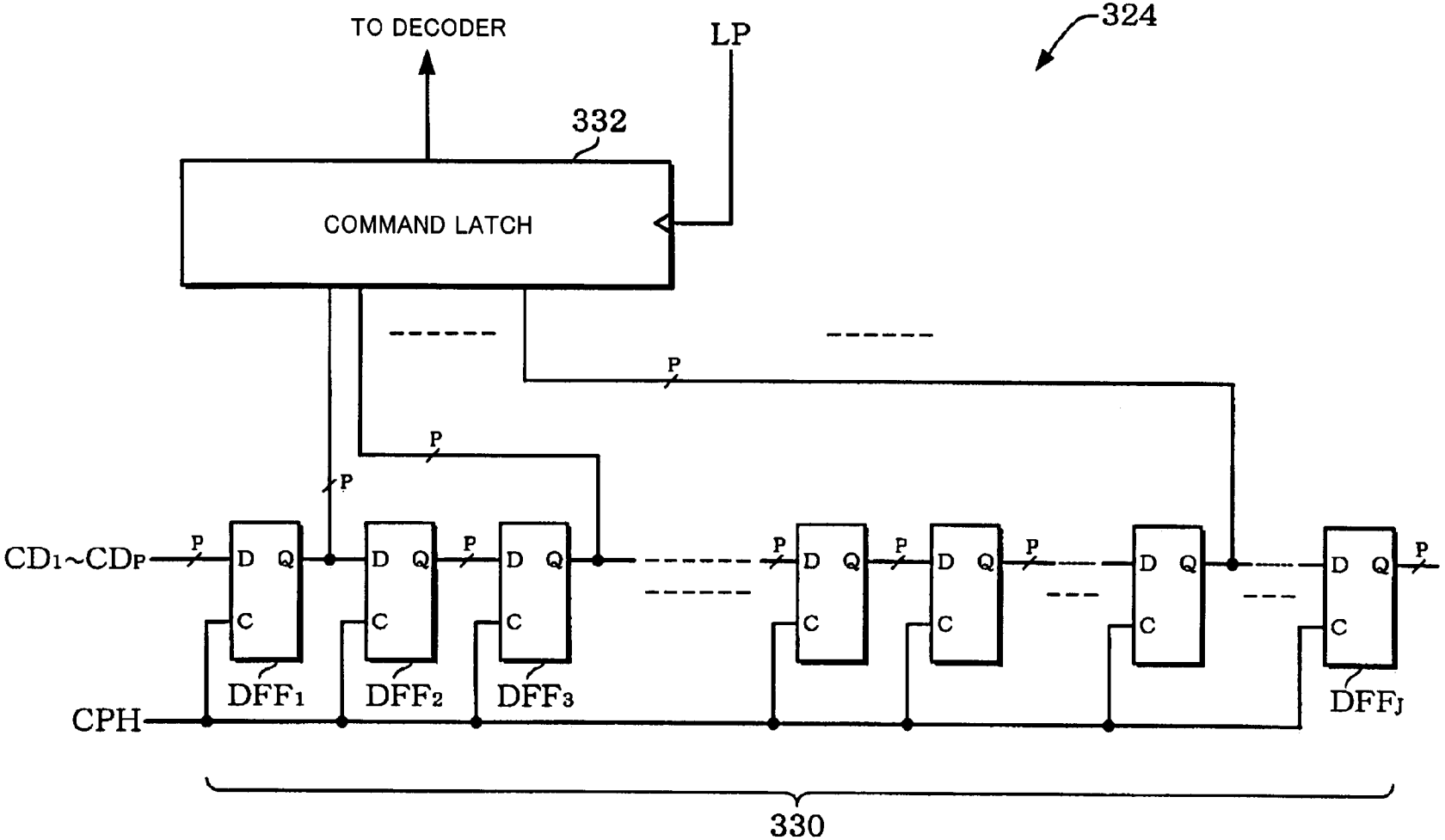
FIG. 22 is a block diagram of an example of the configuration of the latch of the third embodiment.

A configurational example of the latch 324 is shown in FIG. 22. The latch 324 could include a shift register 330 and a command latch 332.

The shift register 330 has first to J-th flip-flops $DFF_1$ to $DFF_J$ (where J is an integer of at least two digits). The flip-flop $DFF_j$ (where j is an integer such that $1 \leqq j \leqq J$) has a clock terminal C, an input terminal D, and an output terminal Q. The flip-flop $DFF_j$ holds a data signal at the input terminal D at the rise of an input signal at the clock terminal C, and outputs the thus-held data signal from the output terminal Q.

The flip-flops can hold p bits of grayscale data. The output of the j-th flip-flop $DFF_j$ is connected to the input of the (j+1)th flip-flop $DFF_{j+1}$. The input data that has been input to the first flip-flop $DFF_1$ is shifted in synchronization with the shift clock CPH.

The command latch 332 fetches the data that is held in a previously determined flip-flop, of the data held in the first to J-th flip-flops $DFF_1$ to $DFF_J$, in synchronization with the rise of the latch pulse LP. In this case, the previously determined flip-flop is the flip-flop where the fetched command data has been shifted at a previously determined timing within one horizontal scan period.

The command data that has been fetched into the command latch 332 in this manner is decoded by the decoder 326. The decoder 326 first analyzes whether or not the fetched command data is execution command data.

Figure 23:
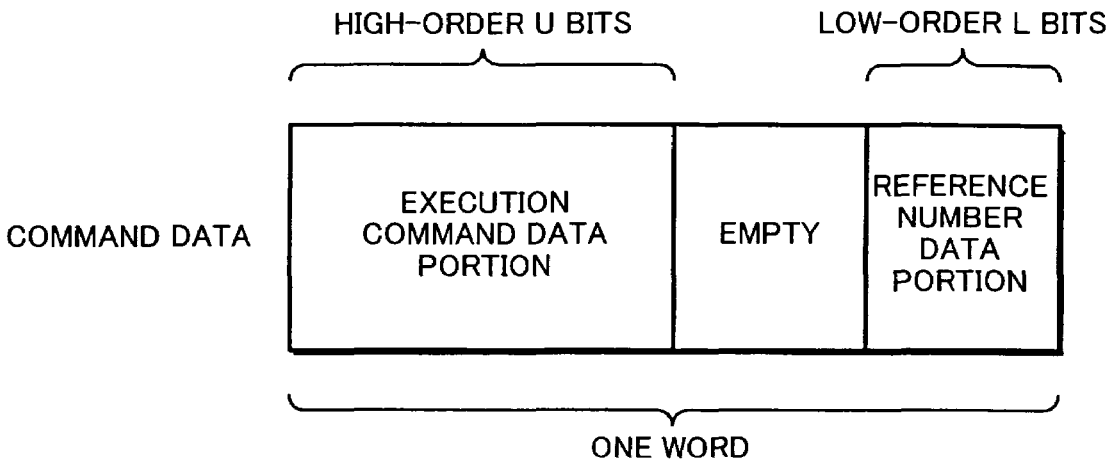
FIG. 23 is an illustrative view of an example of the configuration of command data in accordance with the third embodiment.

An example of the configuration of command data analyzed by the decoder 326 is shown in FIG. 23. The decoder 326 first analyzes command data such as that shown in FIG. 23. This command data has an execution command data portion in the high-order U bits of one word (where U is a natural number) and a reference number data portion in the low-order L (where L is a natural number) bits thereof. In this case, a word is a unit of a predetermined number v of bits (where v is an integer such that $v \geqq p$).

If the data of the execution command data portion corresponds to a given execution command, the decoder 326 continues the decoding to determine whether or not the number of words indicated by the reference number data portion is an ordinary command.

Figure 24:
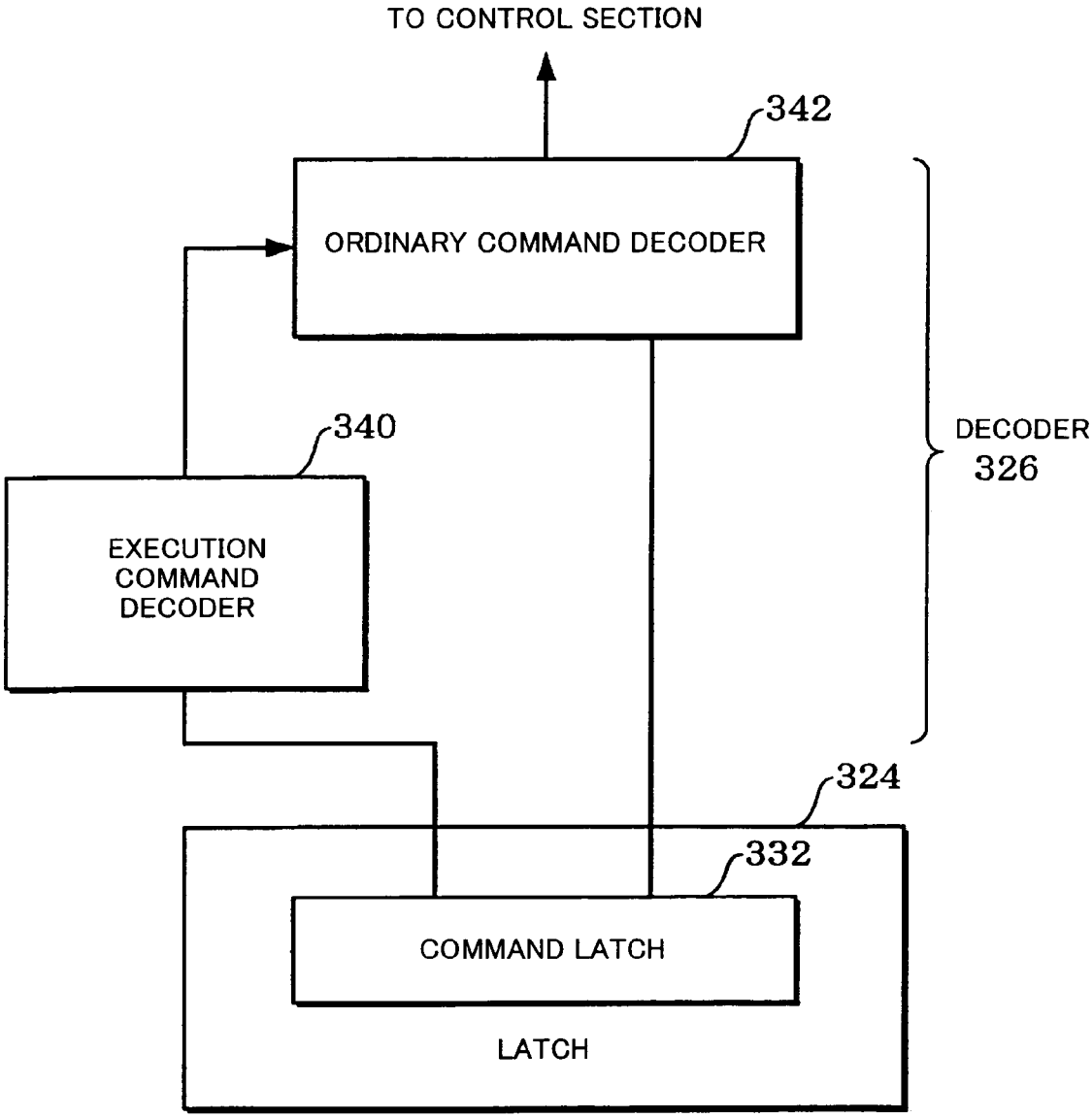
FIG. 24 is a block diagram of an example of the configuration of the decoder of the third embodiment.

An outline of the configuration of the decoder 326 is shown in FIG. 24. The decoder 326 includes an execution command decoder 340 and an ordinary command decoder 342.

The execution command decoder 340 decodes the data of the execution command data portion, which is part of the data held in the command latch 332.

If it is determined that the data of the execution command data portion is a given execution command, based on the decoding result of the execution command decoder 340, the ordinary command decoder 342 extracts the number of words of command data indicated by the reference number data portion from the command latch 332 and decodes that command data. The number of words of command data indicated by the reference number data portion is data at a word position other than the word position of the word that includes the above-mentioned execution command data portion.

The result of the decoding of the ordinary command decoder 342 is output to the control section 110.

It is preferable that the thus-configured decoder 326 operates in synchronization with a clock of a frequency higher than that of the latch pulse LP, in a similar manner to the first embodiment. It is also preferable that that clock is the shift clock CPH.

The control section 110 can perform control based on the control signal generated by that control section 110, in the next horizontal scan period after the horizontal scan period in which the data decoded by the decoder 326 was fetched, as shown in FIG. 10.

Figure 25:
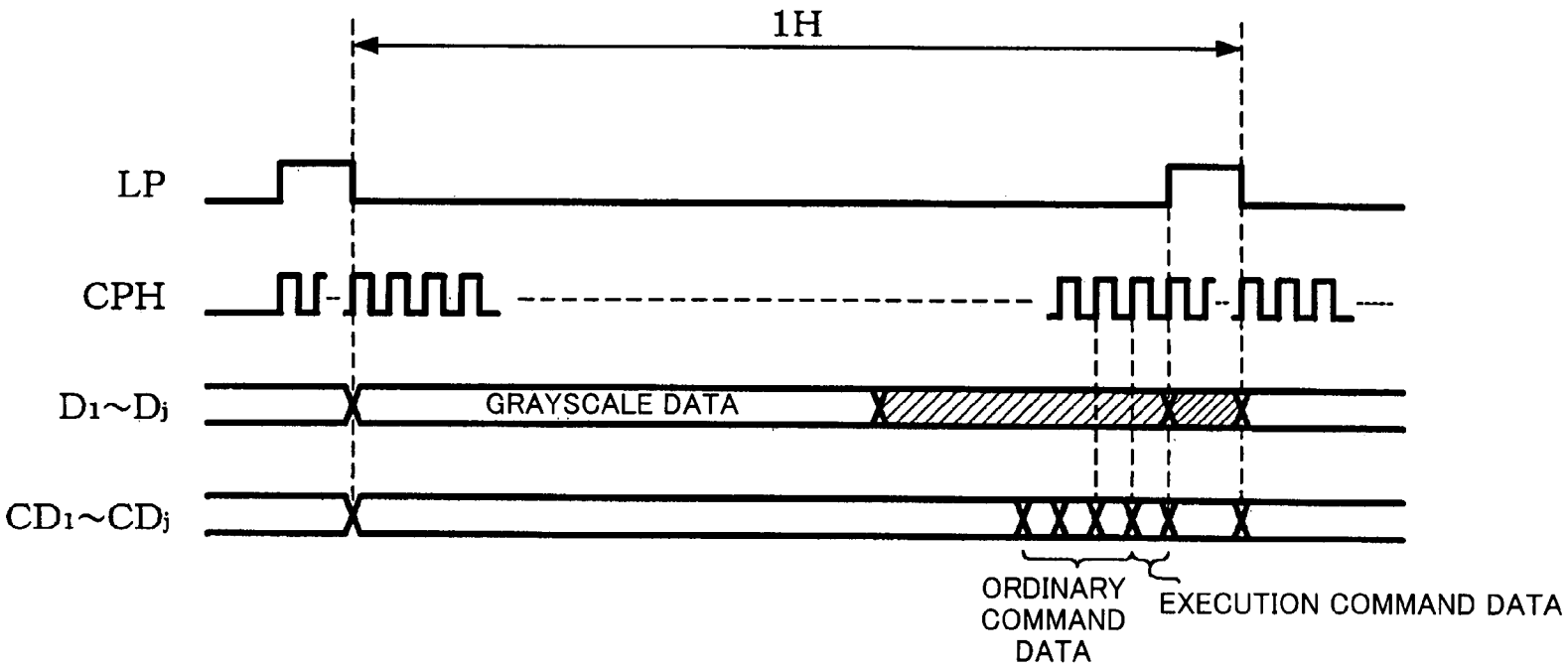
FIG. 25 is a timing chart of an example of the operational timing of the controller and the data line drive circuit of the third embodiment.

An example of the operational timing of the data line drive circuit 320 of the third embodiment is shown in FIG. 25. In this case, the description of the data line drive circuit 320 refers to the configuration shown in FIG. 21.

Data that is display data (grayscale data) and command data which has been multiplexed in a time-division manner is input to the data line drive circuit 320 within one horizontal scan period (1H). Command data that has been multiplexed at a time-division timing regulated by pixel units is input from the controller 300 within 1H.

The command latch 332 fetches the input data (command data) that was held in the shift register 330 previously, in synchronization with the rise of the latch pulse LP.

The decoder 326 extracts the previously determined word of command data from the command latch 332, analyzes the data equivalent to the execution command data portion, and determines whether or not it is an execution command.

If it is determined to be an execution command, the decoder 326 extracts command data at the word position specified by the reference number data portion, from the command latch 332. If the word position having the execution command data portion is the S-th word, by way of example, and if the reference number data portion indicates "3", it extracts command data at the (S-1)th, (S-2)th, and (S-3)th word positions. The decoding of the ordinary command is done with reference to the thus-extracted command data. This simplifies the expansion of control since it is sufficient merely to increase the number of words used for reference, even if the control details are expanded and the number of types of command data increases.

The result of decoding the ordinary command by the decoder 326 is output to the control section 110. The control section 110 outputs a control signal corresponding to the result of this decoding.

Note that it is preferable that the numbers of bits for each color component in the grayscale data of the display data in the first and second modes are similar to those of the first embodiment.

Note that the present invention is not limited to these embodiments and thus various modifications thereto are possible within the scope of the invention laid out herein.

Part of requirements of any claim of the present invention could be omitted from a dependent claim which depends on that claim. Moreover, part of requirements of any independent claim of the present invention could be made to depend on any other independent claim.

The above-described embodiments disclose the items listed below.

One embodiment of the present invention relates to a display system comprising:

a display panel including a plurality of pixels, a plurality of data lines, and a plurality of scan lines;

a display driver which drives the data lines; and a display controller which supplies display data to the display driver and also controls the display driver, wherein the display controller:

includes first to (j+2)th data output terminals (where j is a natural number) for outputting (j+2) bits of display data out of display data that is output in a k-bit unit (where k is an integer such that $k \geqq j+2$);

outputs display data in a j-bit unit to the display driver through the first to j-th data output terminals;

outputs command data for controlling the display driver instead of the (j+1)th bit of display data, through the (j+1)th data output terminal to the display driver; and outputs a command identification signal for identifying the command data instead of the (j+2)th bit of display data, through the (j+2)th data output terminal to the display driver, and wherein the display driver includes:

first to j-th data input terminals for inputting display data in a j-bit unit;

a latch which fetches the command data that is specified according to the command identification signal;

a decoder which decodes the command data fetched into the latch; and a control section which outputs a control signal corresponding to a decoding result by the decoder, the display driver driving the data lines based on the control signal and the display data that has been input through the first to j-th data input terminals.

In this embodiment, the display controller is configured to enable the output of display data through the first to (j+2)th data output terminals. In this display controller, display data is output through the first to j-th data output terminals and also a command identification signal and command data for controlling the display driver are output through the (j+1)th and (j+2)th data output terminals. The display driver decodes the command data specified by the command identification signal, and imposes display control corresponding to the result of that decoding.

This makes it possible to provide control by command data through the remaining data output terminals, even if a general-purpose display controller is used. Since the command identification signal and the command data can be handled in a manner similar to that of display data, it becomes possible to use a general-purpose display controller to control a display driver that is controlled by commands.

Another embodiment of the present invention relates to a display system comprising:

a display panel including a plurality of pixels, a plurality of data lines, and a plurality of scan lines;

a display driver which drives the data lines; and a display controller which supplies multiplexed data including display data to the display driver and also controls the display driver, wherein the display controller:

includes first to (j+1)th data output terminals (where j is a natural number) for outputting (j+1) bits of display data out of display data that is output in a k1-bit unit (where k1 is an integer such that $k1 \geqq j+1$);

outputs multiplexed data in which display data and command data has been time-division multiplexed within one horizontal scan period, in a j-bit unit to the display driver through the first to j-th data output terminals; and outputs a command identification signal for identifying the command data instead of the (j+1)th bit of display data, to the display driver through the (j+1)th data output terminal, and wherein the display driver includes:

first to j-th data input terminals for inputting display data in a j-bit unit;

a latch which fetches command data from the multiplexed data, specified according to the command identification signal;

a decoder which decodes the command data fetched into the latch; and a control section which outputs a control signal corresponding to a decoding result by the decoder; the display driver driving the data lines based on the control signal and the display data included within the multiplexed data that has been input through the first to j-th data input terminals.

In this embodiment, the display controller is configured to be able to output display data through the first to (j+1)th data output terminals. In this display controller, display data is output through the first to j-th data output terminals and also a command identification signal is output through the (j+1)th data output terminal. The display driver decodes the command data specified by the command identification signal from the multiplexed data, and imposes display control corresponding to the result of that decoding.

This makes it possible to provide control by command data through the remaining data output terminals, even if a general-purpose display controller is used. Since the command identification signal and the command data can be handled in a manner similar to that of display data, it becomes possible to use a general-purpose display controller to control a display driver that is controlled by commands. In addition, since the command data is multiplexed with the display data, it is possible to omit a terminal and signal line used for inputting the command data.

A further embodiment of present invention relates to a display system comprising:

a display panel including a plurality of pixels, a plurality of data lines, and a plurality of scan lines;

a display driver which drives the data lines; and a display controller which supplies display data to the display driver and also controls the display driver;

wherein the display controller:

includes first to (j+p)th data output terminals (where j is a natural number) for outputting (j+p) bits of display data out of display data that is output in a k2-bit unit (where k2 and p are positive integers such that k2≧j+p);

outputs display data in a j-bit unit to the display driver through the first to j-th data output terminals; and outputs command data instead of the (j+1)th to (j+p)th bits of the display data through the (j+1)th to (j+p)th data output terminals to the display driver, and wherein the display driver includes:

first to j-th data input terminals for inputting display data in a j-bit unit;

a latch which fetches the command data;

a decoder which decodes the command data fetched into the latch; and a control section which outputs a control signal corresponding to a decoding result by the decoder, the display driver driving the data lines based on the control signal and the display data that has been input through the first to j-th data input terminals.

In this embodiment, the display controller is configured to enable the output of display data through the first to (j+p)th data output terminals. In this display controller, display data is output through the first to j-th data output terminals and also command data is output in a p-bit unit through the (j+1)th to (j+p)th data output terminals. The display driver decodes the command data that is input in a p-bit unit and imposes display control corresponding to the result of that decoding.

This makes it possible to provide control by command data through the remaining data output terminals, even if a general-purpose display controller is used. Since the command data can be handled in the same way as display data, it becomes possible to use a general-purpose display controller to control a display driver that is controlled by commands. In addition, command data can be supplied in a p-bit unit to the display driver, enabling the implementation of efficient control.

In a display system in accordance with this embodiment, when j bits of display data include grayscale data for an R color component, a G color component and a B color component, number of bit of grayscale data for the G color component may be larger than number of bit of grayscale data for the R color component, and may be also larger than number of bit of grayscale data for the B color component.

This embodiment makes it possible to transfer grayscale data efficiently without any deterioration of image quality of the display panel, and also implement control over the display driver by a general-purpose display controller.

A still further embodiment of the present invention relates to a display controller which controls a display driver which drives a data line of a display panel, based on display data which is input in a j-bit unit (where j is a natural number); the display controller including:

first to (j+2)th data output terminals;

a mode setting register for setting an operation mode of the display controller to a first or second mode;

a command data output section which outputs command data for controlling the display driver and a command identification signal for specifying the command data; and a display data output section which outputs display data in a k-bit unit (where k is an integer such that k≧j+2) or a j-bit unit, wherein the display data output section:

outputs (j+2) bits of display data out of display data that is output in a k-bit unit, through the first to (j+2)th data output terminals, in a first mode; and outputs display data in a j-bit unit through the first to j-th data output terminals, and also outputs command data instead of the (j+1)th bit of display data through the (j+1)th data output terminal and the command identification signal instead of the (j+2)th bit of display data through the (j+2)th data output terminal, in a second mode.

An even further embodiment of the present invention relates to a display controller which controls a display driver which drives a data line of a display panel, based on display data which is input in a j-bit unit (where j is a natural number); the display controller comprising:

first to (j+1)th data output terminals;

a mode setting register for setting an operation mode of the display controller to a first or second mode;

a command data output section which outputs a command identification signal for specifying command data for controlling the display driver; and a display data output section which outputs multiplexed data in which display data in a k1-bit unit (where k1 is an integer such that k1≧j+1) or a j-bit unit and the command data are multiplexed, within one horizontal scan period, wherein the display data output section:

outputs the multiplexed data including (j+1) bits of display data out of display data that is output in a k1-bit unit, through the first to (j+1)th data output terminals, in a first mode; and outputs the multiplexed data including display data in a j-bit unit through the first to j-th data output terminals, and also outputs the command identification signal at a time corresponding to command data included within the display data instead of the (j+1)th bit of display data, through the (j+1)th data output terminal, in a second mode.

A yet further embodiment of the present invention relates to a display controller which controls a display driver which drives a data line of a display panel, based on display data which is input in a j-bit unit (where j is a natural number); the display controller comprising:

first to (j+p)th (where p is a natural number) data output terminals;

a mode setting register for setting an operation mode of the display controller to a first or second mode;

a command data output section which outputs command data for controlling the display driver; and a display data output section which outputs display data in a k2-bit unit (where k2 is a positive integer such that k2≧j+p) or a j-bit unit, wherein the display data output section:

outputs (j+p) bits of display data out of display data that is output in a k2-bit unit, through the first to (j+2)th data output terminals, in a first mode; and outputs display data in a j-bit unit through the first to j-th data output terminals, and also outputs command data instead of the (j+1)th to (j+p)th bits of display data through the (j+1)th to (j+p)th data output terminals, in a second mode.

In a display controller in accordance with this embodiment, when j bits of display data include grayscale data for an R color component, a G color component and a B color component, number of bit of grayscale data for the G color component may be larger than number of bit of grayscale data for the R color component, and may be also larger than number of bit of grayscale data for the B color component.

In a display controller in accordance with this embodiment, when display data includes grayscale data for an R color component, a G color component, and a B color component:

display data in which number of bit of grayscale data for each of the R color component, the G color component, and the B color component is the same may be output in the first mode; and display data in which number of bit of grayscale data for at least one of the R color component, the G color component, and the B color component is different may be output in the second mode.

This embodiment makes it possible for the display controller to output display data in which the number of bits of grayscale data for the R color component, the G color component, and the B color component are the same, in the first mode. It is therefore possible to provide a general-purpose display controller to supply the display data to the display driver. In the second mode, the configuration of the grayscale data supplied to the display driver can be changed, enabling an increase in the efficiency of grayscale data transfer. It is also possible to utilize the remaining data lines to implement control of the display driver by command data.

What is claimed is:

1. A display system comprising:

a display panel including a plurality of pixels, a plurality of data lines, and a plurality of scan lines;

a display driver which drives the data lines; and a display controller which supplies display data to the display driver and also controls the display driver, wherein the display controller:

includes first to (j+2)th data output terminals (where j is a natural number) for outputting (j+2) bits of display data out of display data that is output in a k-bit unit (where k is an integer such that $k \geqq j+2$);

outputs display data in a j-bit unit to the display driver through the first to j-th data output terminals;

outputs command data for controlling the display driver instead of the (j+1)th bit of display data, through the (j+1)th data output terminal to the display driver; and outputs a command identification signal for identifying the command data instead of the (j+2)th bit of display data, through the (j+2)th data output terminal to the display driver, and wherein the display driver includes:

first to j-th data input terminals for inputting display data in a j-bit unit;

a latch which fetches the command data that is specified according to the command identification signal;

a decoder which decodes the command data fetched into the latch; and a control section which outputs a control signal corresponding to a decoding result by the decoder, the display driver driving the data lines based on the control signal and the display data that has been input through the first to j-th data input terminals.

2. A display system comprising:

a display panel including a plurality of pixels, a plurality of data lines, and a plurality of scan lines;

a display driver which drives the data lines; and a display controller which supplies multiplexed data including display data to the display driver and also controls the display driver, wherein the display controller:

includes first to (j+1)th data output terminals (where j is a natural number) for outputting (j+1) bits of display data out of display data that is output in a k1-bit unit (where k1 is an integer such that $k1 \geqq j+1$);

outputs multiplexed data in which display data and command data has been time-division multiplexed within one horizontal scan period, in a j-bit unit to the display driver through the first to j-th data output terminals; and outputs a command identification signal for identifying the command data instead of the (j+1)th bit of display data, to the display driver through the (j+1)th data output terminal, and wherein the display driver includes:

first to j-th data input terminals for inputting display data in a j-bit unit;

a latch which fetches command data from the multiplexed data, specified according to the command identification signal;

a decoder which decodes the command data fetched into the latch; and a control section which outputs a control signal corresponding to a decoding result by the decoder; the display driver driving the data lines based on the control signal and the display data included within the multiplexed data that has been input through the first to j-th data input terminals.

3. A display system comprising:

a display panel including a plurality of pixels, a plurality of data lines, and a plurality of scan lines;

a display driver which drives the data lines; and a display controller which supplies display data to the display driver and also controls the display driver;

wherein the display controller:

includes first to (j+p)th data output terminals (where j is a natural number) for outputting (j+p) bits of display data out of display data that is output in a k2-bit unit (where k2 and p are positive integers such that $k2 \geqq j+p$);

outputs display data in a j-bit unit to the display driver through the first to j-th data output terminals; and outputs command data instead of the (j+1)th to (j+p)th bits of the display data through the (j+1)th to (j+p)th data output terminals to the display driver, and wherein the display driver includes:

first to j-th data input terminals for inputting display data in a j-bit unit;

a latch which fetches the command data;

a decoder which decodes the command data fetched into the latch; and a control section which outputs a control signal corresponding to a decoding result by the decoder, the display driver driving the data lines based on the control signal and the display data that has been input through the first to j-th data input terminals.

4. The display system as defined by claim 1, wherein, when j bits of display data include grayscale data for an R color component, a G color component and a B color component, number of bit of grayscale data for the G color component is larger than number of bit of grayscale data for the R color component, and is also larger than number of bit of grayscale data for the B color component.

5. The display system as defined by claim 2, wherein, when j bits of display data include grayscale data for an R color component, a G color component and a B color component, number of bit of grayscale data for the G color component is larger than number of bit of grayscale data for the R color component, and is also larger than number of bit of grayscale data for the B color component.

6. The display system as defined by claim 3, wherein, when j bits of display data include grayscale data for an R color component, a G color component and a B color component, number of bit of grayscale data for the G color component is larger than number of bit of grayscale data for the R color component, and is also larger than number of bit of grayscale data for the B color component.

7. A display controller which controls a display driver which drives a data line of a display panel, based on display data which is input in a j-bit unit (where j is a natural number); the display controller including:

first to (j+2)th data output terminals;

a mode setting register for setting an operation mode of the display controller to a first or second mode;

a command data output section which outputs command data for controlling the display driver and a command identification signal for specifying the command data; and a display data output section which outputs display data in a k-bit unit (where k is an integer such that k≧j+2) or a j-bit unit, wherein the display data output section:

outputs (j+2) bits of display data out of display data that is output in a k-bit unit, through the first to (j+2)th data output terminals, in a first mode; and outputs display data in a j-bit unit through the first to j-th data output terminals, and also outputs command data instead of the (j+1)th bit of display data through the (j+1)th data output terminal and the command identification signal instead of the (j+2)th bit of display data through the (j+2)th data output terminal, in a second mode.

8. A display controller which controls a display driver which drives a data line of a display panel, based on display data which is input in a j-bit unit (where j is a natural number); the display controller comprising:

first to (j+1)th data output terminals;

a mode setting register for setting an operation mode of the display controller to a first or second mode;

a command data output section which outputs a command identification signal for specifying command data for controlling the display driver; and a display data output section which outputs multiplexed data in which display data in a k1-bit unit (where k1 is an integer such that k1≧j+1) or a j-bit unit and the command data are multiplexed, within one horizontal scan period, wherein the display data output section:

outputs the multiplexed data including (j+1) bits of display data out of display data that is output in a k1-bit unit, through the first to (j+1)th data output terminals, in a first mode; and outputs the multiplexed data including display data in a j-bit unit through the first to j-th data output terminals, and also outputs the command identification signal at a time corresponding to command data included within the display data instead of the (j+1)th bit of display data, through the (j+1)th data output terminal, in a second mode.

9. A display controller which controls a display driver which drives a data line of a display panel, based on display data which is input in a j-bit unit (where j is a natural number); the display controller comprising:

first to (j+p)th (where p is a natural number) data output terminals;

a mode setting register for setting an operation mode of the display controller to a first or second mode;

a command data output section which outputs command data for controlling the display driver; and a display data output section which outputs display data in a k2-bit unit (where k2 is a positive integer such that k2≧j+p) or a j-bit unit, wherein the display data output section:

outputs (j+p) bits of display data out of display data that is output in a k2-bit unit, through the first to (j+2)th data output terminals, in a first mode; and outputs display data in a j-bit unit through the first to j-th data output terminals, and also outputs command data instead of the (j+1)th to (j+p)th bits of display data through the (j+1)th to (j+p)th data output terminals, in a second mode.

10. The display controller as defined by claim 7, wherein, when j bits of display data include grayscale data for an R color component, a G color component and a B color component, number of bit of grayscale data for the G color component is larger than number of bit of grayscale data for the R color component, and is also larger than number of bit of grayscale data for the B color component.

11. The display controller as defined by claim 8, wherein, when j bits of display data include grayscale data for an R color component, a G color component and a B color component, number of bit of grayscale data for the G color component is larger than number of bit of grayscale data for the R color component, and is also larger than number of bit of grayscale data for the B color component.

12. The display controller as defined by claim 9, wherein, when j bits of display data include grayscale data for an R color component, a G color component and a B color component, number of bit of grayscale data for the G color component is larger than number of bit of grayscale data for the R color component, and is also larger than number of bit of grayscale data for the B color component.

13. The display controller as defined by claim 7, wherein, when display data includes grayscale data for an R color component, a G color component, and a B color component:

display data in which number of bit of grayscale data for each of the R color component, the G color component, and the B color component is the same is output in the first mode; and display data in which number of bit of grayscale data for at least one of the R color component, the G color component, and the B color component is different is output in the second mode.

14. The display controller as defined by claim 8, wherein, when display data includes grayscale data for an R color component, a G color component, and a B color component:

display data in which number of bit of grayscale data for each of the R color component, the G color component, and the B color component is the same is output in the first mode; and display data in which number of bit of grayscale data for at least one of the R color component, the G color component, and the B color component is different is output in the second mode.

15. The display controller as defined by claim 9, wherein, when display data includes grayscale data for an R color component, a G color component, and a B color component:

display data in which number of bit of grayscale data for each of the R color component, the G color component, and the B color component is the same is output in the first mode; and display data in which number of bit of grayscale data for at least one of the R color component, the G color component, and the B color component is different is output in the second mode.

16. The display controller as defined by claim 10, wherein, when display data includes grayscale data for an R color component, a G color component, and a B color component:

display data in which number of bit of grayscale data for each of the R color component, the G color component, and the B color component is the same is output in the first mode; and display data in which number of bit of grayscale data for at least one of the R color component, the G color component, and the B color component is different is output in the second mode.

17. The display controller as defined by claim 11, wherein, when display data includes grayscale data for an R color component, a G color component, and a B color component:

display data in which number of bit of grayscale data for each of the R color component, the G color component, and the B color component is the same is output in the first mode; and display data in which number of bit of grayscale data for at least one of the R color component, the G color component, and the B color component is different is output in the second mode.

18. The display controller as defined by claim 12, wherein, when display data includes grayscale data for an R color component, a G color component, and a B color component:

display data in which number of bit of grayscale data for each of the R color component, the G color component, and the B color component is the same is output in the first mode; and display data in which number of bit of grayscale data for at least one of the R color component, the G color component, and the B color component is different is output in the second mode.

* * * * *